United States Patent [19]

Eichorn, deceased et al.

[11] 4,003,333

[45] Jan. 18, 1977

[54] DEVELOPMENT SYSTEM

[75] Inventors: Roger H. Eichorn, deceased, late of Webster, N.Y.; by Lincoln First Bank of Rochester, executor, Rochester, N.Y.

[73] Assignee: Xerox Corporation, Stamford, Conn.

[22] Filed: Apr. 18, 1975

[21] Appl. No.: 569,337

[52] U.S. Cl. ..... 118/653; 118/257

[51] Int. Cl.[2] ..... G03G 13/08

[58] Field of Search ..... 118/257, 621, 637; 101/122

[56] References Cited

UNITED STATES PATENTS

| | | | |
|---|---|---|---|
| 3,093,039 | 6/1963 | Rheinfrank | 118/637 X |
| 3,203,394 | 8/1965 | Hope et al. | 118/637 |
| 3,211,090 | 10/1965 | Irwin et al. | 118/257 X |
| 3,696,783 | 10/1972 | Fantuzzo | 118/637 |
| 3,786,514 | 1/1974 | Pressman et al. | 118/637 X |
| 3,857,549 | 12/1974 | Snelling | 118/637 X |

*Primary Examiner*—Mervin Stein

*Attorney, Agent, or Firm*—James J. Ralabate; Michael H. Shanahan; Max J. Kenemore

[57] ABSTRACT

Apparatus for transporting particulate development material from a container to a remote location for development of an electrostatic latent image. Also disclosed is a multilayered donor belt for use in a particulate development system.

1 Claim, 41 Drawing Figures

DEVELOPMENT SYSTEM

BACKGROUND OF THE INVENTION

This invention is concerned mainly with printing apparatus, and specifically with such apparatus which rely upon non-impact imaging processes and somewhat simulate in appearance and function devices known as typewriters.

Intensive efforts in research and development in recent years have resulted in many improvements in printing devices. Many modern typewriters exhibit sophisticated characteristics which enable them to produce superior copy in both manual and automatic modes. For instance, instead of the usual type of key-moving carriage arrangement used in most typewriters, at least one typewriter utilizes a rotatable "daisy wheel" which moves in a direction transverse to the paper to be printed upon, thereby eliminating carriage movement. Likewise, developments have been made which have resulted in quieter typewriters, as well as typewriters which are less complex mechanically which results in greater reliability.

The greater printing speeds now obtainable have permitted very efficient automatic modes to be realized. Peripheral equipment such as magnetic card and tape units are commonplace. These memory and command units provide ease of error correction, data storage and low quantity line copy reproduction. Some presently known typewriters even have the capability of receiving and processing commands from computers.

Even with the advent of electronic components such as the keyboard disclosed in U.S. Pat. No. 3,778,817, most modern typewriters are relatively noisy since some impact mechanism must usually strike the paper or other receiving medium employed. Likewise, while the reliability of typewriters has been greatly increased, a relatively large number of parts are still employed. Additionally, the mechanical impact printing means generally employed limit either the maximum printing speed or the cost due to the need for multiple parallel printing elements to achieve high printing speeds.

SUMMARY OF THE INVENTION

It is an object of this invention to provide a simple and reliable development system.

It is another object of this invention to provide a novel system for transporting particulate development material from a container to a remote location for the development of an electrostatic latent image.

It is another object of this invention to provide a system for transporting particulate development material on an endless loop donor web in such a manner as to never contact the transporting surface with a roller or other guide means.

It is a still further object of this invention to provide a novel donor belt.

It is another object of this invention to provide a novel multilayered donor belt comprising a conductive layer, an insulative layer and a conductive screen.

These and other objects are obtained by providing apparatus for transporting particulate development material from a container to a remote location for development of an electrostatic latent image. Also disclosed is a multilayered donor belt for use in a particulate development system.

BRIEF DESCRIPTION OF THE DRAWINGS

For a better understanding of the invention as well as other objects and further features thereof, reference is made to the following detailed disclosure of various preferred embodiments of the invention taken in conjunction with the accompanying drawings thereof wherein.

DESCRIPTION OF THE PREFERRED EMBODIMENTS

Figure 1:
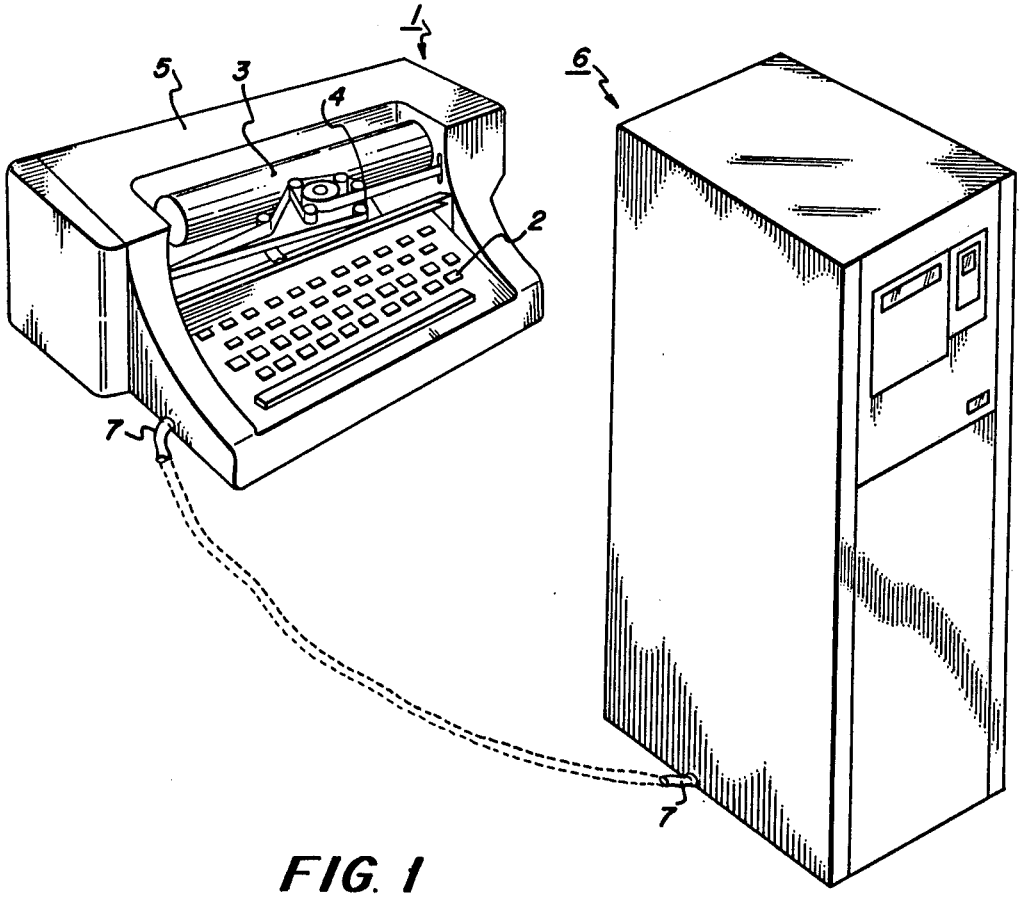
FIG. 1 is a perspective view of the general apparatus of the instant invention.

Briefly, FIG. 1 depicts a general representation of the printing apparatus of the instant invention. Typewriter 1 is comprised of a keyboard 2, a platen 3 upon which the receiving medium is contained and transferred, and a printing head 4 which may take several forms, as set forth below. Control and operating mechanisms are enclosed within the housing 5. Also shown in this figure is an optional automatic control unit 6 which is attached to typewriter 1 by cable 7. Control unit 6 is generally a memory unit of the type well-known in the art as a magnetic tape or magnetic card unit, but may also be an electronic reader or a transmission unit from a remote source. Any suitable automatic control source may be used.

Figure 2A:
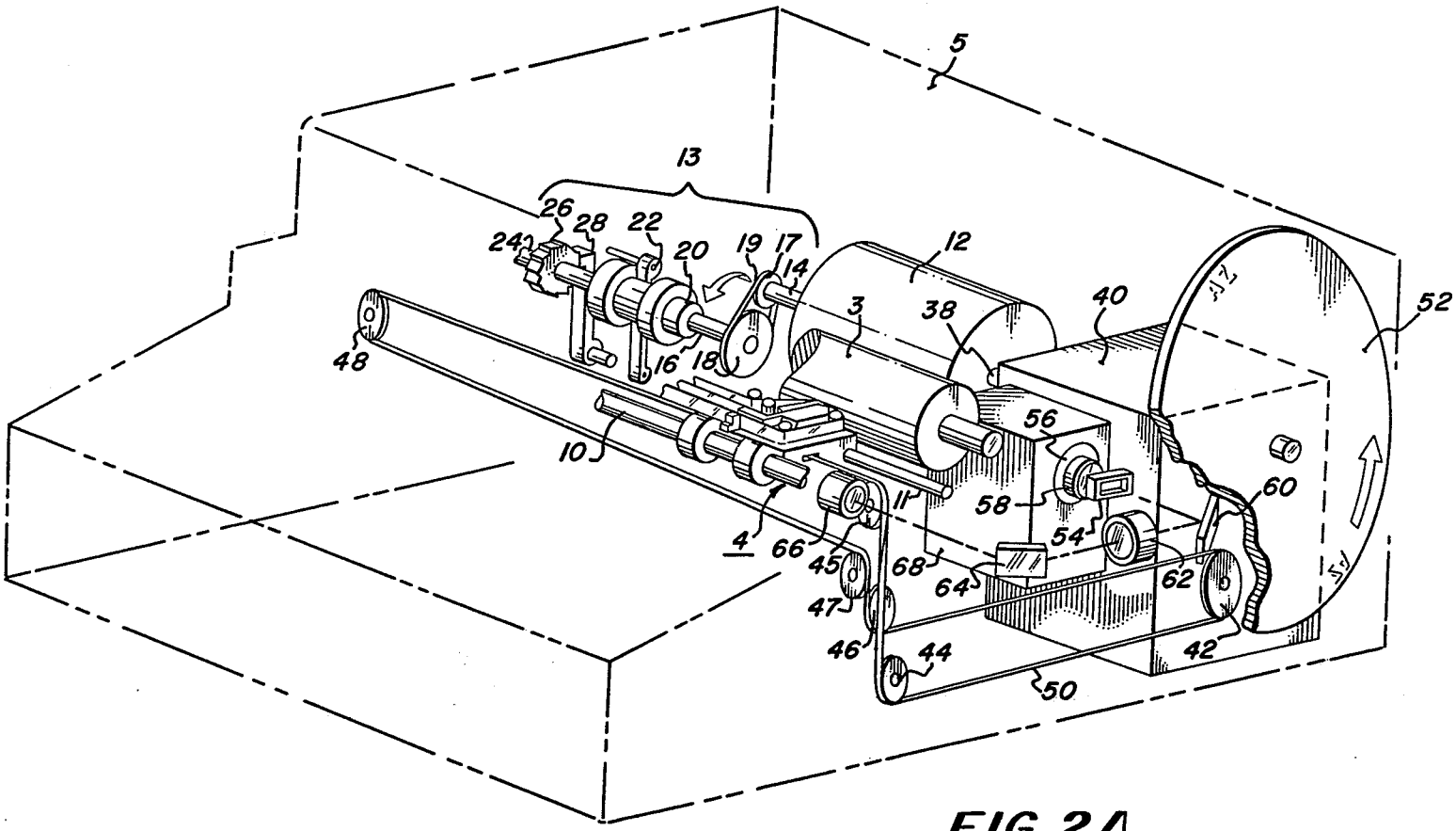
FIG. 2A is a partial perspective view of a print head drive suitable for use in the instant invention.

Attention is now directed to FIG. 2A wherein the printing head drive and generalized exposure system are shown. Within housing 5 a cylindrical platen 3 is supported at its ends for controlled axial rotation and advancement of the receiving medium which is partially wrapped therearound. The platen may be of any suitable construction well-known in the art. Printing head 4 is slidably mounted on two shafts 10 and 11 which permit the head to move axially along the length of the platen 3 as commanded by the drive mechanism. Printing head 4 may take any of the many forms set forth below, but generally requires the uniform transfer of material to the receiving medium, and therefore, the actual printing position is as nearly on a plane with the axis of the platen as is practicable.

The entire drive mechanism is powered by electric motor 12 which is coupled, on one end, to the imaging material supply and takeup reel drive means 13. Rotational power is transferred from motor shaft 14 to shaft 16 via pulleys 17, 18 and belt 19. Clutch 20 regulates the amount of rotational power transferred to coaxial shaft 24 under the control of escapement lever 22 whereby the takeup reel (not shown) is actuated. Ratchet 26 controls the outer portion of coaxial shaft 24, to which the supply reel (not shown) is attached. Upon activation of pawl 28 it moves out of engagement, and the supply reel is allowed to supply new imaging material under the urging of the imaging material tension. The takeup and supply reels, though not shown, may take any suitable form known in the art and may be mounted in any conventional manner so long as they are controlled by coaxial shaft 24. The imaging material on the reels is kept under constant tension by a suitable spring and roller means (not shown) which is attached to escapement lever 22 whereby the slack imparted by the feeding of new material causes the takeup reel to be actuated.

On the opposite end of electric motor 12 drive shaft 38 is coupled to synchronous cam print head drive 40, which will be described in more detail below. The output of print head drive 40 is concentrated primarily in drive pulley 42 which is made to rotate in either clockwise or counter-clockwise directions. Control cable 50 is fixed at both ends to print head 4, and through a series of fixed pulleys 44–48, causes the print head to slide along shafts 10 and 11 in response to the rotation of drive pulley 42.

Also driven by synchronous cam print head drive 40 is the character disc 52. Disc 52 is fully described in U.S. Pat. No. 3,750,539, but generally is a flat disc with transparent alpha-numeric regions in an otherwise opaque material along the periphery thereof in a slight helical path. The specific character to be printed is positioned in window 54 where illumination from lamp 56 and lens 58 projects an image thereof onto mirror 60. Lamp 56 may take many forms of rapid switching high intensity devices, but for purposes of illustration is a xenon flash lamp. The image on mirror 60 is transmitted through lens 62 onto mirror 64 and then to lens 66. Both lenses 62 and 66 are focused at infinity and have the appropriate relative size and focal lengths so to allow for the varying locations of the printing head 4 and provide the desired image size at the exposure plane.

Within print head 4 there are an array of mirrored surfaces or other conventional optic elements which direct the image to the recording medium either simultaneously with or before transfer to the receiving medium. Lamp housing 68 contains the switching mechanism and power supply for lamp 56.

The print head drive mechanism shown in FIG. 2A further includes a subsystem for moving the print transfer member on the print head 4 into and out of contact with a receiving sheet on the platen 3. This subsystem is shown in schematic FIG. 2B. Many of the embodiments to be described below include a print transfer member, generally shown as 30 in FIG. 2B, which is slidingly attached to print head 4 for movement into and out of contact with a receiving medium on platen 3. The image carrying material slides or moves across the member 30 and is selectively pressed into contact with the receiver to effect transfer. Lever 32 is pivotally fixed at fulcrum 33 and to member 30 on one end and cable 34 at the other whereby a pulling motion on the cable causes the member 30 to move into contact with the receiver. Member 30 is biased by spring means 31 to aid in the return motion. The cable 34 is directed around pulleys 39 back to the print head 4 wherein it is fixed. Solenoid 36 is attached to one of the pulleys 39 and is pulled against stops 35 by the cable force due to spring 31. When the solenoid 36 is actuated it pulls the attached pulley 39 outward and overcomes the spring force of 31, causing the lever 32 to move. Therefore, it can be seen that activation of solenoid 36 causes the cable 34 to pull lever 32 and thereby move print transfer member 30 into contact with platen 3. Also, it should be understood that it is preferred that element 30 be on the top surface of the base, and the remaining elements be below the surface or contained within the base.

Referring again to FIG. 2A, it should be understood that platen 3 may be rotated by any of a number of structures well known or readily fashionable by one of skill in the art. For instance, a step motor geared to the platen shaft would allow complete control of the relative positioning of the print head and the receiving medium. By using sufficiently small steps, provision for plotting and super and subscript printing may easily be made. In the alternative, various ratchet and solenoid structures may be employed.

Figure 3:
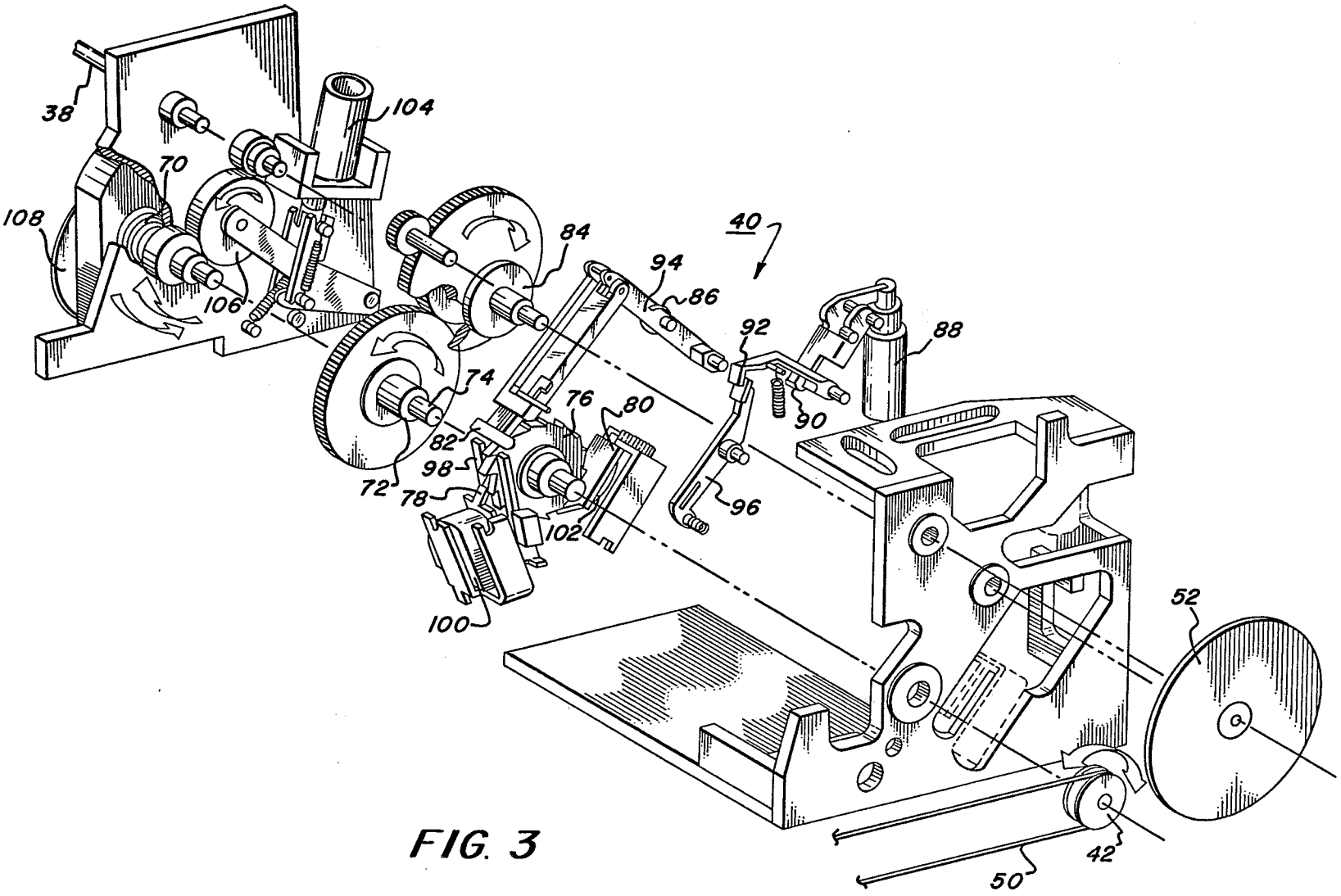
FIG. 3 is an exploded perspective view of the synchronous cam drive mechanism.

The prime function of synchronous cam print head drive 40, see FIG. 3, is to assure synchronous and phased motion between the print head 4 and the constant speed and relative position of character disc 52 at the instant of printing. As stated above, printing occurs when xenon lamp 56 flashes through the spinning character disc and the proper character is imaged on the moving print head. The helical displacement of characters on the disc compensates for the motion of the print head such that the selected character image from each character set on the wheel can be placed on the same lateral position on the paper.

The print head 4 is actually driven by a power spring 70 which is rewound during the print head return operation. However, the speed at which the power spring can move the head is limited by an overspeed clutch 72 which is geared directly to character disc 52. The power spring and overspeed clutch are concentric to the output shaft 74 on which are mounted the drive pulley 42 and control ratchet 76.

The control ratchet 76 is activated by two electrically operated stop pawls 78 and 80, and cam operated puller pawl 82. The puller pawl oscillates continuously under the influence of cam 84 and cam follower 86 and moves to turn ratchet 76 clockwise when released by latch solenoid 88. When the latch solenoid is energized, it inserts an interposer 90 between the latch 92 and the cam follower arm 94. When the arm 94 is driven against interposer 90 by cam 84, the latch 92 releases the pawl arm 96 which forces the puller pawl 82 into mesh with the teeth of ratchet 76.

The motion imparted to the ratchet by the cam, through the puller pawl, causes the ratchet (and thus the print head) to back up approximately 1½ character spaces (ratchet teeth); then, the cam allows the power spring 70 to accelerate the ratchet in the forward direction until the ratchet speed is limited by the overspeed clutch 72. The puller pawl 82 is disengaged from the ratchet teeth by the release lever 98 just as the ratchet speed is being limited by the clutch. This limit is the synchronous speed during which printing occurs while the character disc and print head motions are in phase. The stop pawls are held out of engagement by their electromagnets 100 and 102 until released to stop the ratchet; at that time one of the stop pawls will be released by its electromagnet and engage the proper ratchet tooth, bringing the ratchet to a halt. The ratchet 76 is composed of two phase-shifted ratchet discs. Stop pawl 78 works on one disc of ratchet 76 and stop pawl 80 works on the other ratchet disc. Thus one stop pawl operates for all the even character positions and the other for the odd positions. Puller pawl 82 spans both discs.

The ratchet is driven in the return direction when the reverse solenoid 104 is energized and the friction reverse drive 106 rewinds the power spring 70.

The synchronous cam print head drive 40, shown in FIGS. 2A and 3, can be replaced by a D.C. step motor to provide a suitable and similar result. The output shaft of the step motor would, of course, control the movement of drive pulley 42 and character disc 52.

Control Circuitry

Figure 4:
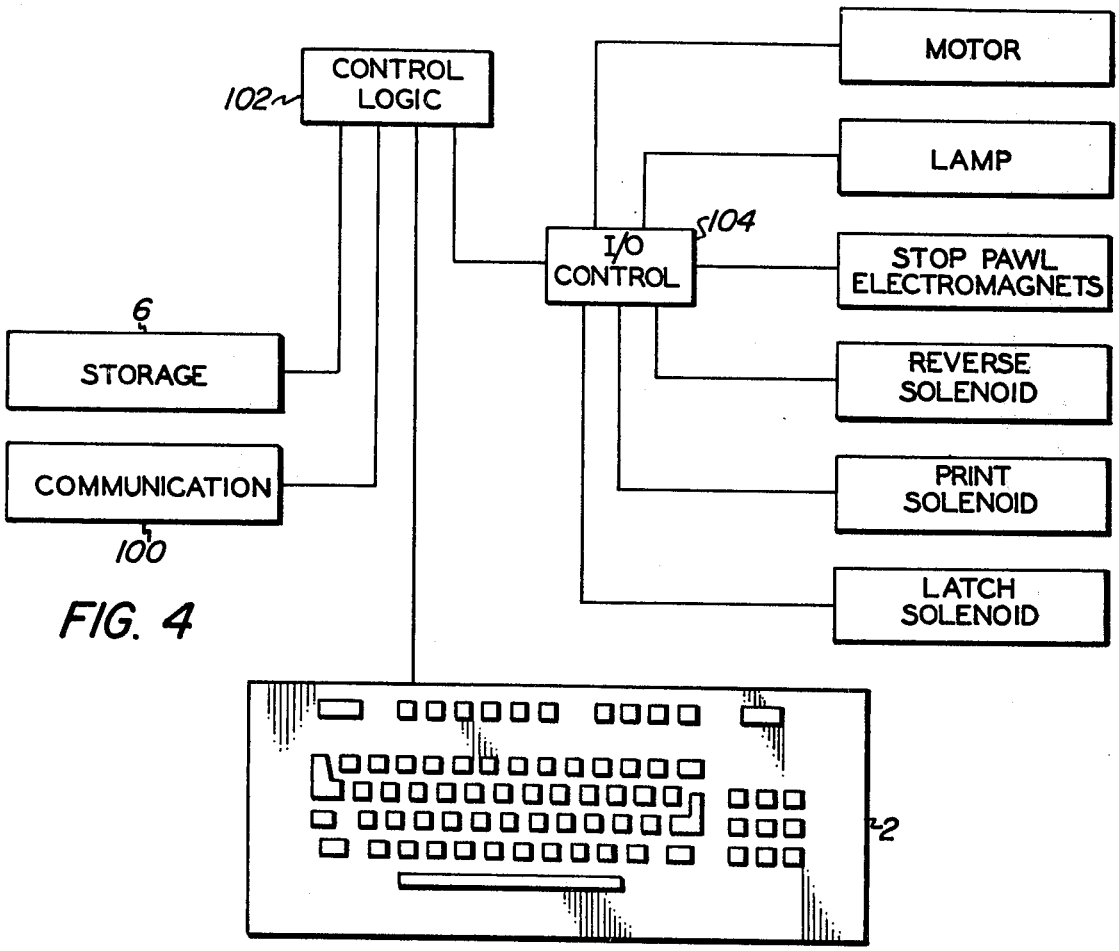
FIG. 4 is a schematic of a control circuitry suitable for use with the instant invention.

In FIG. 4 a basic schematic of the control circuitry is set forth. Command signals are provided through keyboard 2, storage unit 6 or communication unit 100. Unit 100 may be a telephone or like source, while storage unit 6 is generally a magnetic tape card, or disc-like recorder and/or reader. These command signals are in the form of electrical pulses which are directed to control logic circuitry 102. The control logic circuitry is the brain of the system and functions as a control center for all activities which take place while in the printing mode. Logic circuitry 102 may take any form known in the art such as, for example, an LSI Micro-Computer available from Fairchild, or may be made by one of skill in the art based upon system requirements.

Control logic 102 emits electrical pulse signals, corresponding to the command signals, which are received by I/O control unit (input and output) 104 which selectively activates the various system elements, such as shown in the figure. Control logic 102 has an internal clock function and memory which allows storage of the last specified number of command signals, say eight or ten, plus additional storage for another five to ten command signals. The last eight or ten command signals are printed out in a burst or grouping whenever the interval between two successive signals is greater than a certain minimum time period, ¼ second for example. The ¼ second delay can be increased at the option of the operator, up to 1 to 2 seconds. This delay affords the operator a chance to eliminate real time detected typing errors by wiping out the memory before the delay period. The time period chosen should ordinarily be within the normal speed of a person of ordinary skill in touch typing. Storage of the last eight to ten characters is optional. The additional memory storage is used to allow printing during normal continuous typing to occur in bursts. This provides for more efficient use of consumable materials as will be described below and reduces the noise, mechanism stress levels and wear.

From control logic unit 102, the command signals are directed to the operating elements of the system, as shown, in proper sequence.

The circuit elements of the system may take any conventional form, but for convenience, cost and space savings they should generally be of the solid state variety. Also, the specific circuit elements and layout are not shown inasmuch as the workable designs are infinite in number and well within the skill of the art once the desired sequencing is described.

Liquid Manifold Print Head

There has been described in the prior art an imaging process known as Manifold, see, for example U.S. Pat. No. 3,707,368. In that particular patent, the entire disclosure of which is hereby incorporated herein by reference, a cohesively weak photoresponsive imaging layer is sensitized by a liquid and sandwiched between two sheets. The imaging layer is then exposed to a pattern of actinic electromagnetic radiation and an electric field which provides, upon separation of the sandwich, a positive image on one sheet and a negative image on the other.

Figure 5A:
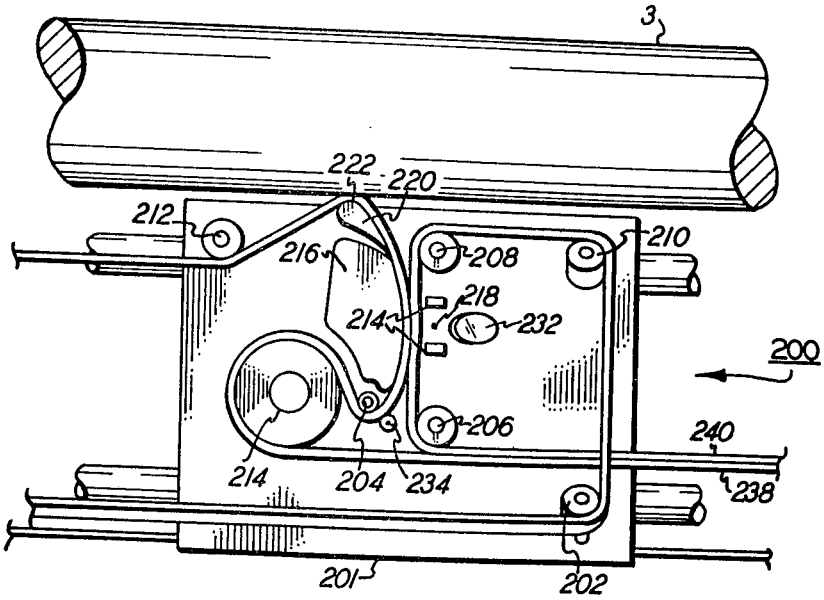
FIGS. 5A and B are top plane and perspective views respectively, of an embodiment of a print head which employs liquid Manifold imaging techniques.
Figure 5B:
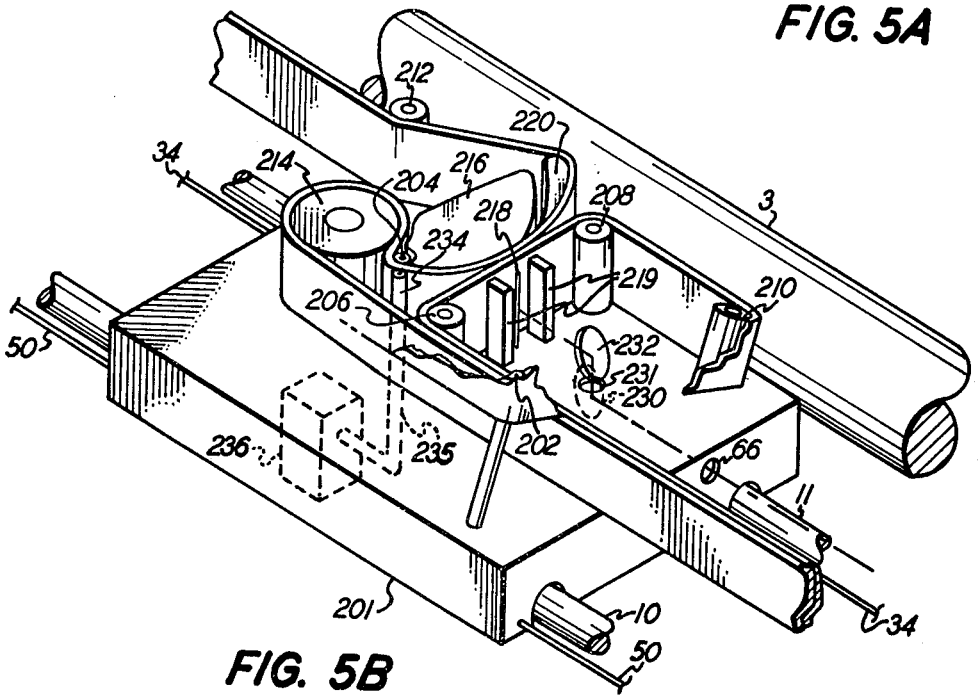

The actual structure of the print head 200 is shown in FIGS. 5A and 5B. The ribbon transport, exposure and transfer mechanisms are all supported by base member 201 which may take any suitable configuration, but is shown generally as a rectangular plate. The materials of which the base member is constructed are of minor concern and are preferably selected with low mass considerations in mind. Rotatably mounted on the base member are a series of guide rollers 202, 204, 206, 208, 210, 212 and 214 which are at least of a size sufficient to guidingly support the ribbon as it is transported through the print head. Guide roller 214 is larger than the other rollers inasmuch as it permits, or provides for, a substantially complete reversal of the film direction. Also, fixedly supported on the base member is an electrode 216 and corotron wire 218 which establish and maintain an electric field across the ribbon sandwich as it moves through the imaging station on its way to the transfer point. Shield members 219 contain the corona discharge within desired limits and assist in stabilizing the charging current. Electrode 216 is comprised generally of a conductive material, at least along the edge thereof which is in sliding contact with the ribbon opposite corotron wire 218. Corotron wire 218 charges the manifold sandwich while allowing an image to be transmitted therethrough. Corotron wire 218 could also precede the exposure step and consist of only a sharp edged electrode in light contact with the surface of the manifold sandwich. The corotron wire does not interfere with the imaging inasmuch as it is small and out of the focal plane of the lens system.

Figure 2B:
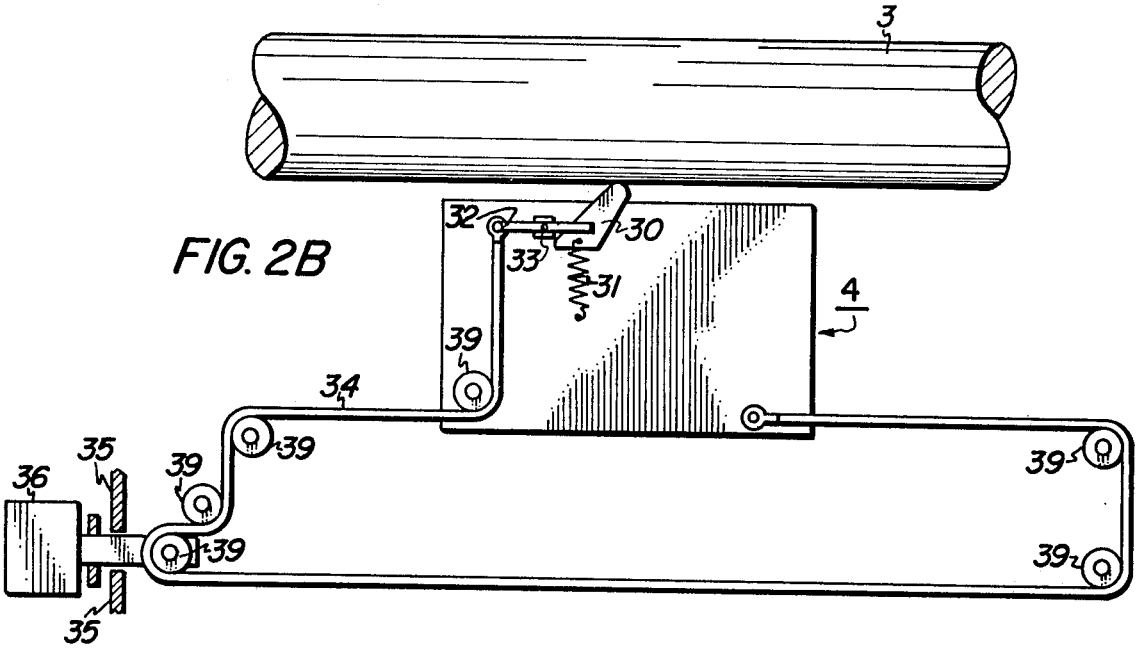
FIG. 2B is a partially schematic, partially cross-sectional view of the apparatus used to move the print transfer member, of some embodiments, into and out of contact with the platen.

Print transfer member 220 is slidingly attached to base member 201 whereby the pressure point thereof, 222, may move the ribbon into and out of contact with the receiving medium on platen 3. The movement of member 220 is controlled via cable 34 as shown in FIG. 2B.

Also associated with the base member, is an illumination system whereby the desired alpha-numeric character is imaged onto the ribbon for recreation on the receiving medium. A lens member 66 is located on the edge of base member 201 and is optically connected, or associated with, a reflection mirror 230 within the base member which redirects the image 90°. The image then passes through opening 531 and onto mirror 232 which in turn directs the image 90° onto the ribbon by corotron wire 218. The mirrors 230 and 232, and the lens 66 provide for an exposure zone at the ribbon of at least two characters in width. This allows for compensation of the motion of the print head while waiting for the desired character on the character disc 52.

Strategically located in the gap created by the splitting of the ribbon sandwich is an applicator roller 234. This roller serves to apply activating liquid to the ribbon and can be a porous metal, plastic or fabric. A variable pressure storage container 236 is attached to the roller 234 via conduit 235 and supplies liquid activator thereto upon command.

In operation, the print head 200 is moved along the two shafts 10 and 11 by command through control cable 50. The base member is located away from platen 3 to permit the receiving medium, for instance a sheet of paper, to be affixed to the platen and moved relative thereto without interference from the print head. The ribbon is initially a two-part sandwich comprised of a receiving layer 238 and a donor layer 240. As the sandwich structure passes roller 206 it is split into its two component parts one of which, 238, is directed to roller 214 and the other of which, 240, is directed toward roller 208. Supply roller 234 is positioned in the gap created by the splitting process and applies a layer of activating liquid on receiver layer 238, after it has passed over guide roller 204 and before layer 238 is again brought into intimate contact with layer 240 whereby the original sandwich structure is recreated. The relative positioning of the rollers 204, 206 and 208 causes the ribbon sandwich to travel in intimate contact with electrode 216. Corotron 218 deposits charge on the outer surface of donor layer 240 and thus establishes an electric field across the Manifold sandwich.

An image of a character is focused onto the ribbon through the illumination system whereby a latent image is created thereon. As the film moves across print transfer member 220 and the print head 200 moves along the length of the platen, print transfer member 220 begins its movement toward the platen. The ribbon sandwich is again split with the receiving layer 238 now carrying an imagewise distributed layer of marking material. As the marking material reaches pressure point 222, it has reached its furthest extension and is pressing the marking material against the receiving medium on platen 3. The motion of the print head causes a pressured wiping action which deposits the marking material on the receiving medium. The print transfer member then transfers the next imagewise shaped marking layer or returns to the rest position. The donor layer is directed by rollers 208, 210 and 202 to takeup reel (not shown) which may be the same reel that receives layer 238.

Thermal Manifold Print Head

Another type of Manifold imaging which has been described in the prior art is referred to as "thermal" manifold. A good description of the process is set forth in U.S. Pat. No. 3,598,581, the entire disclosure of which is entirely expressly incorporated herein by reference. Basically, a sandwich comprising a donor sheet, a cohesively weak photosensitive layer, a low melting layer and a receiving sheet is heated above the melting temperature of the low melting layer, uniformly charged, an electrostatic latent image is formed in the photosensitive layer and the sheets are separated, forming positive and negative image on the two sheets conforming to the latent image.

Figure 6A:
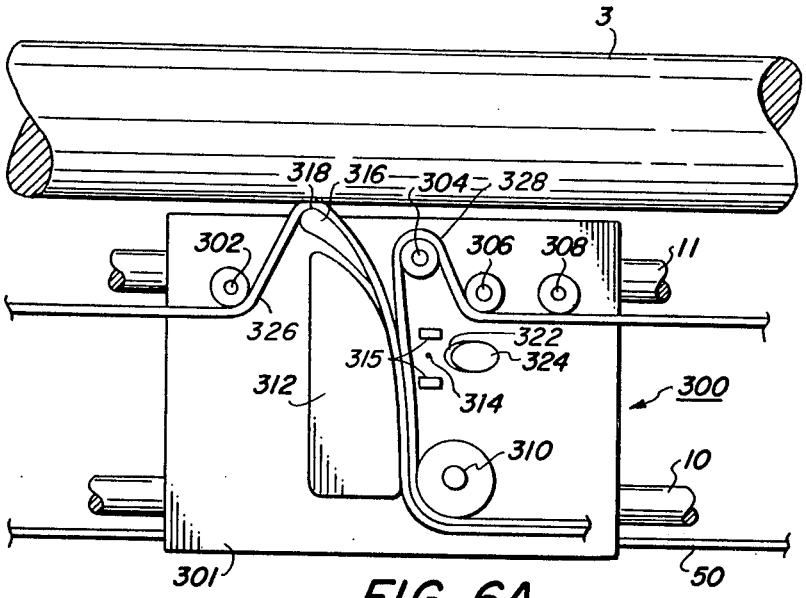
FIGS. 6A and B are top plane and perspective views, respectively, of an embodiment of a print head which employs thermal Manifold imaging techniques.
Figure 6B:
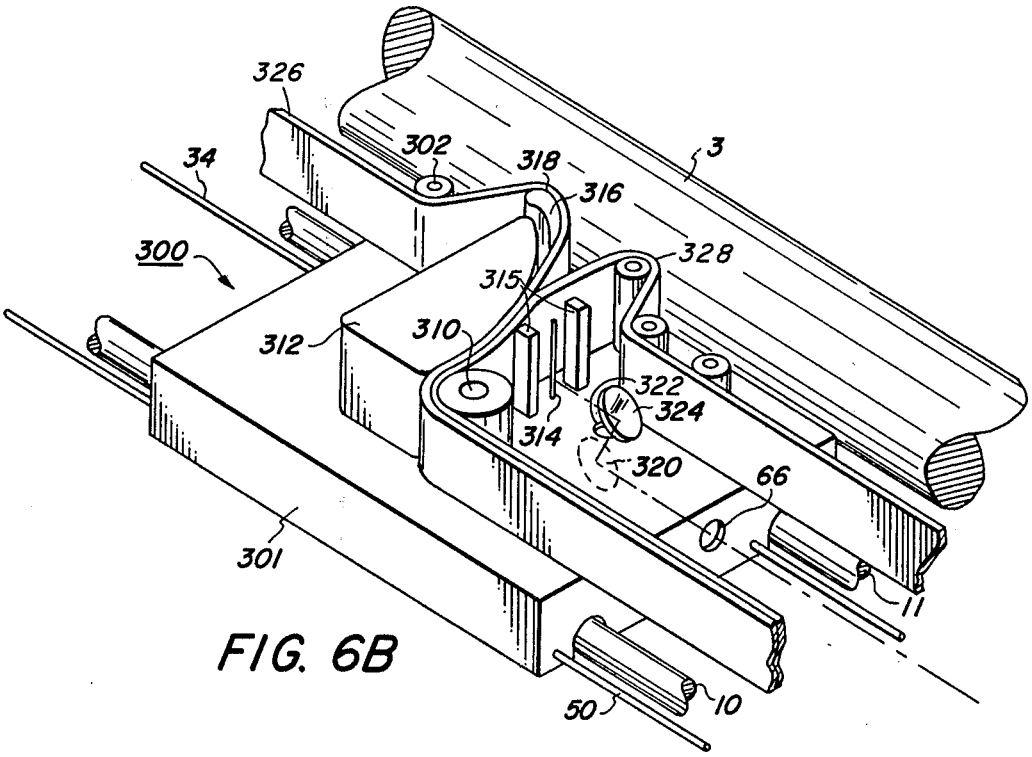

Attention is now directed to FIGS. 6A and B wherein the structure of a printing head 300 suitable for employing the above-described imaging process is shown. The ribbon transport, exposure and transfer mechanisms are all supported by base member 301 which may take any suitable configuration, but is shown generally as a rectangular plate. The material of which the base member is constructed is of minor concern, but is preferably selected with low mass considerations in mind. Rotatably mounted on the base member are a series of guide rollers 302, 304, 306 and 308 which are at least of a size to guidingly hold the ribbon as it is transported through the print head. Heated roller 310 is positioned sufficiently close to the exposure-field station, to be described below, to heat activate the ribbon for proper imaging. The heated roller is generally larger than the remaining guide rollers inasmuch as its ability to activate the ribbon depends upon the contact time, its temperature and the area of contact. Also, fixedly attached to the base member is electrode 312 and corotron wire 314 which establish an electric field across the ribbon sandwich as it moves through the imaging system on its way to the transfer station. Electrode 312 is comprised generally of a conductive material, at least along the edge thereof which is in contact with the ribbon opposite corotron wire 314. Corotron wire 314 charges the ribbon while allowing an image to be transmitted thereby.

Print transfer member 316 is slidingly attached to base member 301 whereby the pressure point thereof, 318 may move the ribbon into and out of contact with the receiving medium on platen 3. The movement of member 316 is controlled via cable 34 as shown in FIG. 2B.

Also associated with the base member is an illumination system whereby the desired alpha-numeric character is imaged onto the ribbon for recreation on the receiving medium. A lens member 66 is located on the edge of base member 301 and is optically connected, or associated with, a reflection mirror 320 within the base member which redirects the image 90°. The image then passes through opening 322 and onto mirror 324, which in turn directs the image 90° onto the ribbon by corotron wire 314 which is shielded by members 315. The mirrors 320 and 324 and the lens 66 provide for an exposure zone at the ribbon of at least two characters in width. This allows for compensation of the motion of the print head while waiting for the desired character on the character disc 52.

In operation, the print head 300 is moved along the two shafts 10 and 11 by command through control cable 50. The base member is located away from platen 3 to permit the receiving medium, for instance a sheet of paper, to be affixed to the platen and moved relative thereto without interference from the print head. The ribbon is initially a two part sandwich comprised of a receiving ribbon 326 and a donor ribbon 328. As the ribbon moves from a supply reel (not shown) onto the printing head it is directed around heated roller 310 which activates the ribbon for imaging. It then passes between electrode 312 and corotron wire 314. Corotron wire 312 establishes an electrostatic field across the ribbon sandwich.

After an electrostatic field has been established across the ribbon and after being heat activated, an image of the character to be printed is focused thereon through the illumination system. As the ribbon moves across print transfer member 316 and the print head 300 moves along the platen, print transfer member 316 begins its movement toward the platen. The ribbon sandwich is split with the receiving layer 326 now carrying an imagewise distributed layer of marking material. As the marking material reaches pressure point 318, it has reached its furthest extension and is pressing the marking material against the receiving medium on platen 3. The motion of the print head causes a wiping action which deposits the marking material on the receiving medium. The print transfer member then transfers the next imagewise shaped marking layer or returns to the rest position. The transfer layer 328 is directed by guide rollers 304, 306 and 308 to a takeup reel (not shown) which may be the same reel that receives layer 326.

Manifold Print Heads with Reusable Loops

The previously described manifold imaging technology, both liquid and thermal, can be used in additional printing embodiments, which exhibit high reliability and increased efficiency in regard to imaging materials usage.

Figure 7A:
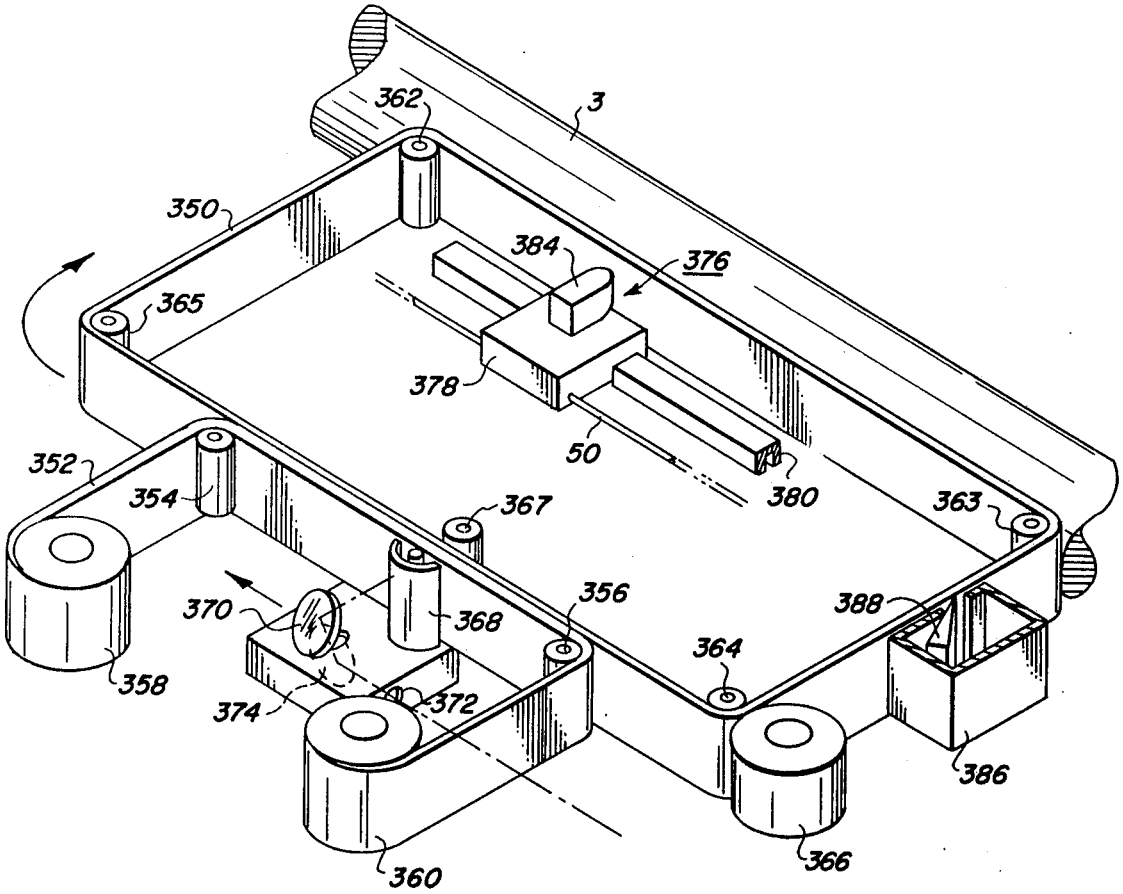
FIGS. 7A, B and C are perspective and top plane views of embodiments of print heads which employ Manifold imaging techniques.
Figure 7B:
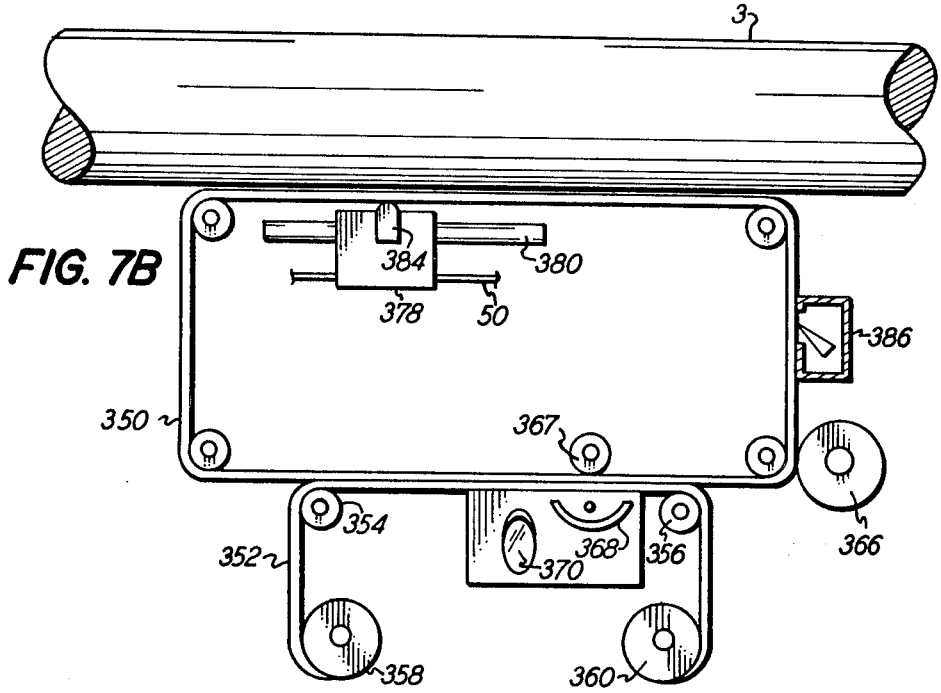

Referring now to FIGS. 7A and 7B, an impactless printing system based upon liquid manifold teachings is shown. In front of platen 3 is a closed loop 350 of insulating material, such as Mylar (polyester film available from DuPont), which is in the form of a ribbon approximately ½ inch in width. Positioned forward of, and in contact with, the closed loop is an open loop 352 of a cohesively weak donor ribbon supported between guide rollers 354 and 356 and takeup and supply reels 358 and 360. The closed loop 350 is supported between guide rollers 362–365.

At or near the point where the two ribbons first come into contact, a liquid activator is applied. Applicator roller 366 performs this function. After the two ribbons have come together to form a sandwich, they are charged by shielded corotron 368 with conductive grounded roller 367 serving as a counter electrode, and exposed to an image from mirror 370. The imagewise pattern of activating radiation is supplied as set forth in previous embodiments through lens 372 and mirror 374. The sandwich is then split apart with the developed images on ribbon 350 being delivered to the region between platen 3 and the transfer member 376.

Print transfer member 376 comprises a low mass plate 378 slidably mounted upon bar member 380. The plate is moved along the bar by cable 50 which drives under the control of the logic circuitry. Pressure applicator 384 moves, also under command of the logic circuitry, into and out of contact with ribbon 350, as shown in FIG. 2B, thereby transferring the image to a receiver on plate 3. This action is initiated only after ribbon 350 has been stopped with the line of character images in the desired position.

Further on around the loop 350 is a cleaning station 386 which comprises a scraper blade 388, or the like, which removes untransferred materials.

It can therefore be seen that the closed loop 350 is reusable, thereby reducing the materials cost of the system.

Figure 7C:
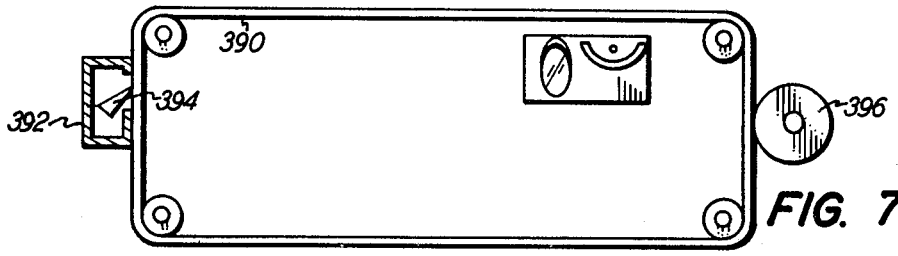

FIG. 7C is to a modification of the above system and shows ribbon 352 as a closed loop 390. A cleaning station 392 (wiper 394) must be added thereto and an applicator roll 396 which adds photoresponsive ink material to the insulating ribbon 390. Note that the embodiment of this figure does not require an activator (366) as do FIGS. 7A and B.

Note further that the above system shown in FIG. 7A may be used in a thermal manifold mode by substituting a heated roller for the liquid applicator 366.

SPLIT BACKUP ROLL

Figure 8:
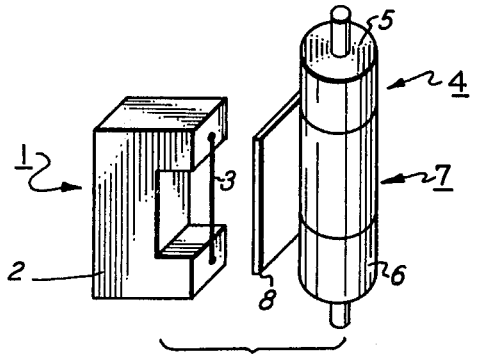
FIG. 8 is a schematic view of a grounded charging roller.

In some modes of the above-described manifold imaging systems, it is necessary that the sandwich be corona charged for imaging. Usually this is accomplished by corona charging through the imaging member to a conductive backup surface or roller. It has been found that the backup roller of FIG. 8 greatly improves the charging step in that it significantly reduces any problems of arcing between the coronode and the conductive counter electrode.

Corona charging block 1 generally comprises a support block 2 and a thin metal wire 3. The backup roll 4 comprises insulating end portions 5 and 6 and conductive center portion 7. Roller 4 is electrically grounded. Imaging member 8 intimately contacts the conductive part of roller 4 and is wider than the length of center section 7. This blocks the arc path between the coronode and section 7.

Flash Exposure Particle Transfer Print Head

In copending U.S. Patent Application Ser. No. 278,340, filed on Aug. 7, 1972, a printing method is described wherein particles, e.g., carbon, are caused to transfer to a receiver after exposure to high energy radiation. This application is hereby entirely expressly incorporated herein by reference.

Figure 9A:
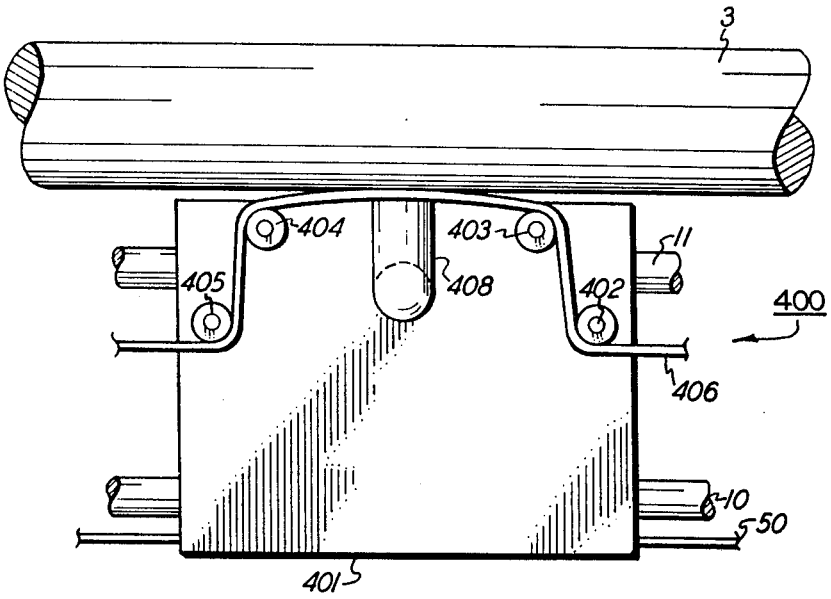
FIGS. 9A and B are top plane and perspective views, respectively, of an embodiment of a print head which employs flash exposure migration imaging techniques.
Figure 9B:
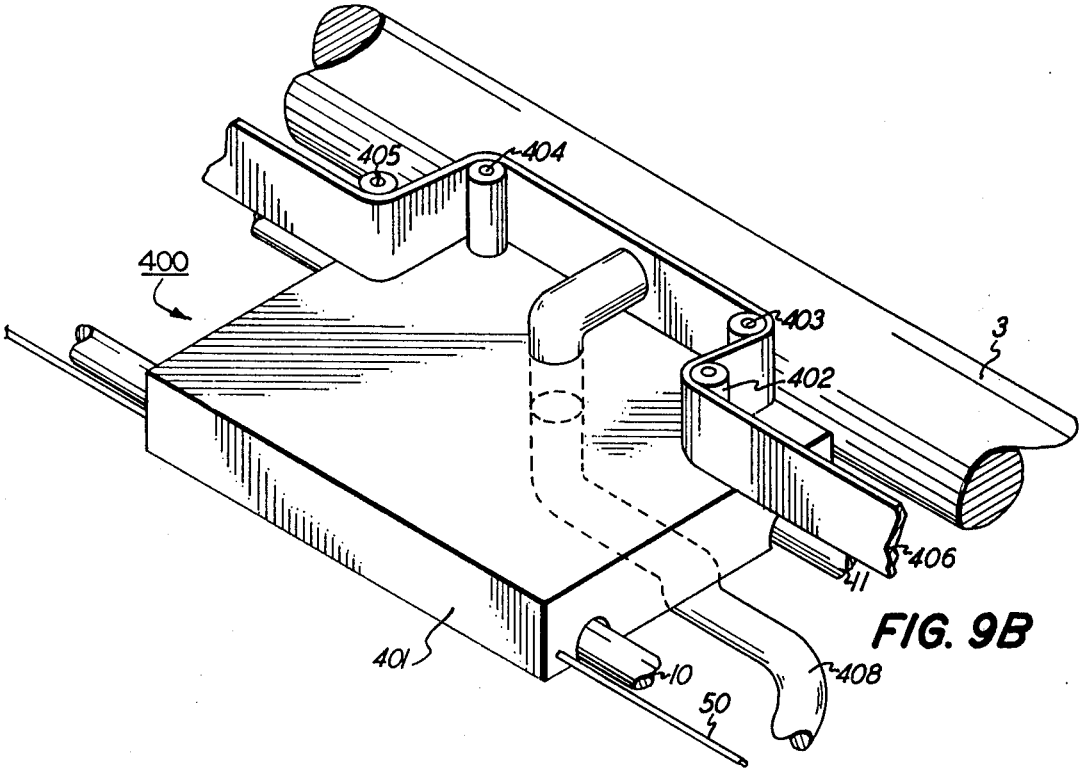

A print head 400 which employs the above imaging process is set forth in FIGS. 9A and 9B. The ribbon transport, exposure and transfer mechanisms are all supported on base member 401 which may take any suitable configuration but is shown generally as a rectangular plate. The material of which the base member is constructed is of minor concern, but is preferably selected with low mass considerations in mind. Rotatably mounted on the base are guide rollers 402–405 which are at least of a size to guidingly hold the ribbon as it is transported through the print head. Rollers 403 and 404 are positioned such that ribbon 406 is either in slight contact with or slightly spaced away from platen 3 to provide a small gap across which the marking material will "jump. "

Also associated with the print head 400 is an illumination system whereby the desired alpha-numeric character is imaged onto the ribbon for recreation on the receiving medium. A flexible fiber optic element 408 with one end adjacent character disc 52 (see FIG. 2A) to receive the character image information protrudes through the base 401 and is directed at ribbon 406. The fiber optic element is of sufficient length and flexibility to permit the print head 400 to travel freely back and forth along its print path.

In this embodiment, it is possible to use a xenon flash tube; however, it is preferred that a laser be used, as at 56 in FIG. 2A, because of its high energy concentration.

In operation, the print head 400 is moved along the two shafts 10 and 11 by command through control cable 50. An image is focused through the illumination system onto the ribbon 406 and marking material transferred to the receiver. The ribbon advances, as does the print head and the next image transferred. Note that the desired print head motion relative to the ribbon is achieved by the ribbon remaining stationary.

Furthermore, there is disclosed in U.S. Pat. No. 3,655,379 a related imaging method wherein a liquid ink layer, formed on the surface of a transparent substrate, is exposed to high energy radiation causing exposed ink areas to move to a receiver sheet. The entire disclosure of this patent is hereby expressly incorporated herein by reference.

The print head embodiment shown in FIGS. 9A and B may be easily modified to employ the above principles by adding an applicator roll in place of guide roller 402 whereby the liquid is evenly applied to the ribbon 406. This embodiment is enhanced by providing closely spaced small protrusions on the ribbon 406 to space the liquid from the receiver paper surface.

Electrographic Print Head

A considerable body of art represented, for example, by U.S. Pat. Nos. 2,919,967; 3,023,731 and 3,064,259 has accumulated over the years in a technological area sometimes referred to as electrographics. In general terms, such a system comprises an insulating member, or sheet, between two electrodes, one of which is shaped in a desired configuration. When the three are brought into intimate contact, and the electrodes activated, a charge pattern is placed upon the insulating member corresponding to the desired configuration. That image may then be xerographically, or otherwise developed, and the image transferred to a receiver.

Figure 10A:
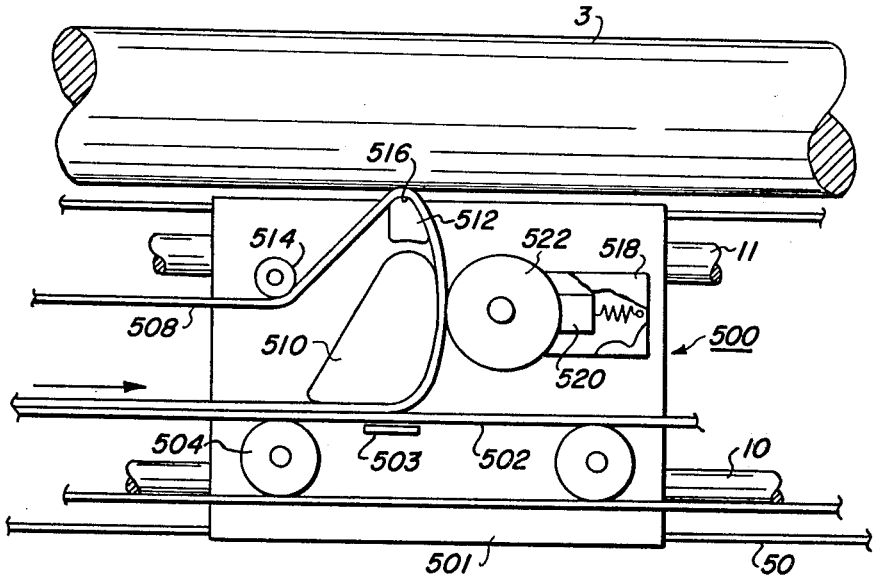
FIGS. 10A, B, D and E are top plane and perspective views of embodiments of print heads which employ electrographic imaging techniques.
Figure 10B:
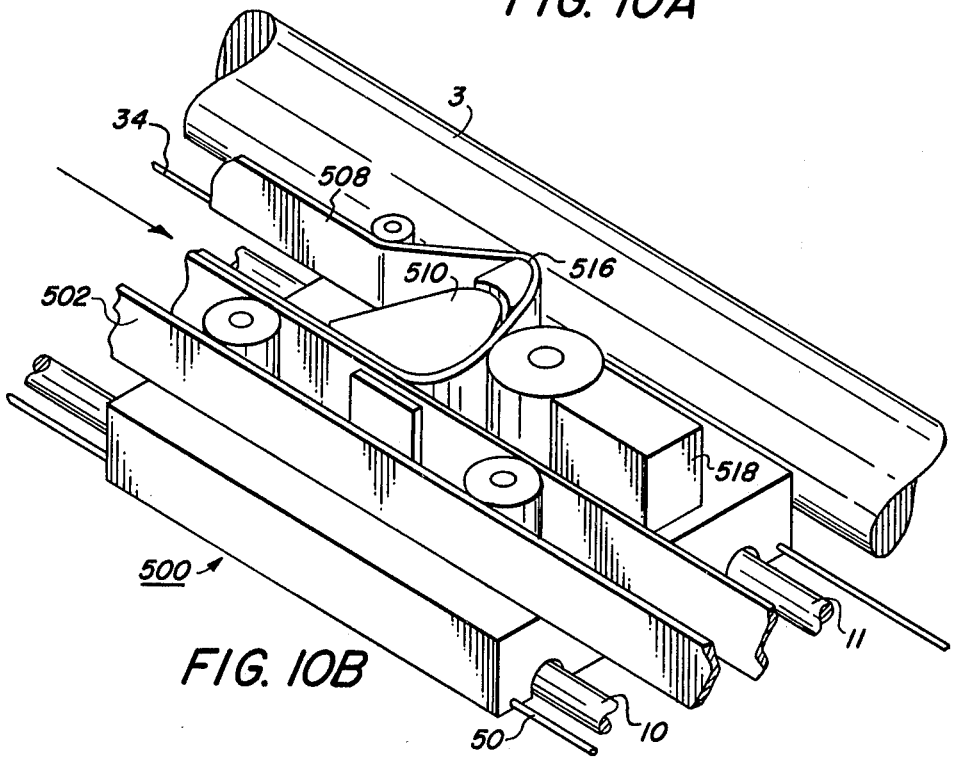
FIG. 10C is a partially schematic, partially cross-sectional view of a character electrode belt suitable for use with the print heads of FIGS. 10A, B, D and E.

Attention is now directed to FIGS. 10A and 10B wherein a novel printing head 500 is shown which is suitable for employing in a useful manner, the imaging process described above. The ribbon transport, imaging, development, and transfer mechanisms are all supported by base member 501 which may take any suitable configuration, but is shown generally as a rectangular plate. The materials of which the base member is constructed is of minor concern, but are preferably selected with low mass considerations in mind.

Closed loop electrode belt 502 is movably suspended between an idler roller and a drive roller (not shown). The idler and drive rollers are located at opposite ends of the print head path of movement, and are controlled by a step motor actuated by the logic circuitry to position the proper character electrode between ribbon 508 and potential source 503. The electrode belt comprises an insulating support 503, as best seen in FIG. 10C, a character-shaped conductive member 505 and a conductive connector 507 running from the back surface of the ribbon to element 505. Therefore, as will be better understood, when a potential is applied between elements 503 and 510, an electrostatic character is deposited on ribbon 508.

Insulating ribbon 508 is threaded into the gap between electrode belt 502 and electrode 510 and is in close contact with electrode 510 and with an air floated spacing to belt 502 of less than 40 microns. Ribbon 508 is further positioned along the edge of electrode 510, around print transfer member 512, around guide roller 514 to a driven takeup reel (not shown). Upon command of the control logic, when the proper character electrode on belt 502 is aligned with electrode 510 and the electrode is pulsed, thereby depositing an electrostatic latent image on the ribbon 508. The ribbon is advanced, developed and brought into contact with print transfer member 512.

The print transfer member 512 is slidingly attached to base member 501 whereby the pressure point thereof, 516, may move the ribbon into and out of contact with the receiving medium on platen 3. The movement of member 512 is controlled via cable 34 as shown in FIG. 2B.

Development may be achieved by any of the well known xerographic techniques, including touchdown, magnetic brush, etc. For purposes of illustration, a thermal SLIC development scheme will be described. Within housing 518 a stick of developer 520 is spring loaded into contact with heated gravure roller 522. The developer 520 is of the type which is solid at room temperatures but liquified upon being heated. Heated gravure roller 522 develops the electrostatic latent images on ribbon 508 as they pass in contact therewith.

Figure 10D:
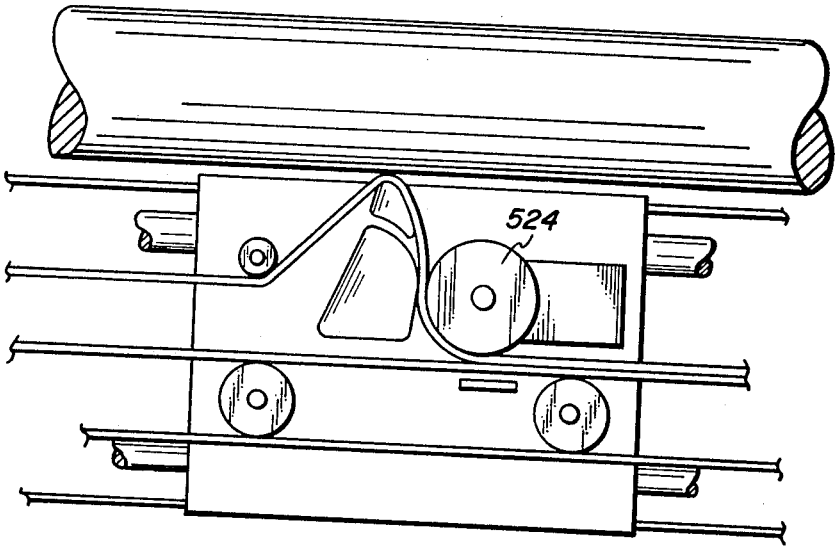
Figure 10C:
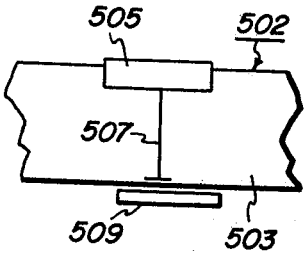
Figure 10E:
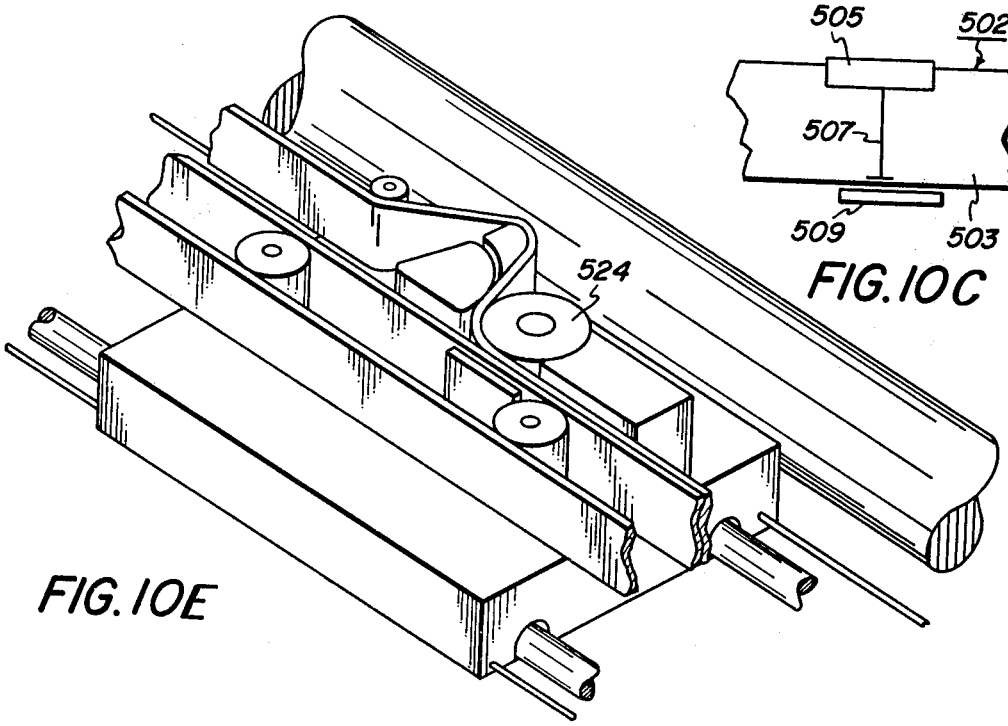

The embodiment shown in FIGS. 10D and E are almost the same as that of FIGS. 10A and B with minor differences. Heated gravure roller 524 is also an electrode and serves the same function as member 510 of FIG. 10A. The primary distinction is that the electrostatic development forces are greater in the FIG. 10D configuration since the imagewise electrostatic charges on ribbon 508 do not have to divide their field between electrode 510 and gravure roll 522. Also, thinner films may be used in the instant embodiment.

Xerographic Print Heads with Liquid Development

In conventional xerography it is usual to form an electrostatic image on a photoconductive or insulating sheet and then develop it by the application of an electrostatically attractable material which deposits in conformity with the electrical latent image to produce a visible record. In U.S. Pat. No. 3,084,043, which is hereby entirely expressly incorporated herein by reference, an alternative development process is disclosed wherein an electrostatic latent image is developed by presenting to the image surface a liquid or ink developer on the surface of a suitable developer dispensing member, such as a gravure roller.

Figure 11A:
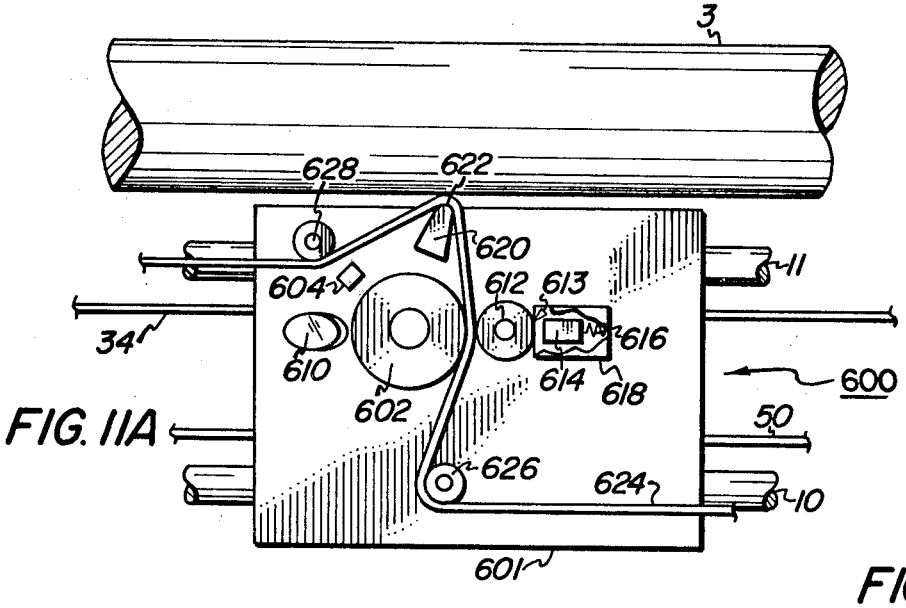
FIGS. 11A and B are top plane and perspective views, respectively, of an embodiment of a print head which employs xerographic SLIC imaging techniques.

The above-described process, often referred to as SLIC (Simple Liquid Ink Copier) is employed in the novel print heads of FIGS. 11A, B and C. The print head 600 is comprised of a base member 601 which supports the necessary exposure, development and transfer mechanisms. The base member may take any suitable configuration, such as, for example, the rectangular plate shown, and may be constructed of any suitable material, preferably low in mass.

The heart of this xerographic printing head is the photoreceptor 602 which comprises a photosensitive material in either layer or binder form. Any of the photoreceptors well known in the art will be suitable, for instance, those shown in U.S. Pat. Nos. 3,621,248 and 3,667,945. The photoreceptor is in the shape of a drum and is rotated on its axis by step motor 640 (FIG. 11B) whereby, upon rotation, the imaging steps may be sequentially performed upon the surface thereof. The drum is at least one character in height and preferably of such a diameter that several characters may be carried on the periphery at one time. Charging station 604 is located ahead of the exposure station and is an element well-known in the art for depositing a uniform charge on a surface, e.g., see U.S. Pat. No. 2,836,725. The charged photoreceptor is exposed to the desired alpha-numeric character through an illumination system comprised of lens 661 reflection mirror 606, opening 608 and mirror 510.

In the particular embodiment shown in FIGS. 11A and B, a unique development system is employed. A heated gravure roller 612 is contacted with a solid stick of developer 614 which is pressed into continuous contact therewith by spring 616 within housing 618. The heat from the gravure is sufficient to liquify the developer stick and cause same to fill the grooves of the gravure. A doctor blade 613 is included within housing 618 to insure that the liquified developer is deposited only in the grooves. When the gravure comes into contact with the latent image, the developer is electrostatically pulled from the grooves to produce a visible image on the ribbon.

Print transfer member 620 is slidingly attached to base member 601 whereby the pressure point thereof, 622, may move the ribbon into and out of contact with the receiving medium on platen 3. The movement of member 620 is controlled via cable 34 as shown in FIG. 2B.

In operation, the print head 600 is moved along the two shafts 10 and 11 by command through control cable 50. The base member is located away from platen 3 to permit the receiving medium, for instance a sheet of paper, to be affixed to the platen and moved relative thereto without interference from the print head. The ribbon 624 is a thin insulator, for example Mylar, and is directed from a supply (not shown) around guide roller 626 and into intimate contact with the protoreceptor 602. The photoreceptor surface is charged, exposed and the ribbon 624 interposed between the photoreceptor and the gravure roll 612. Gravure roller 612 then develops the image on the opposite side of the ribbon from the photoreceptor.

As the ribbon moves across the side of print transfer member 620 and the print head moves along the platen, print transfer member 620 begins its movement toward the platen. This movement is controlled by apparatus shown in FIG. 2B. As the developed image reaches pressure point 622, it has reached its furthest extension and is pressing the image material against the receiving medium on platen 3. The motion of the print head causes a pressured wiping action which deposits the developer on the receiving medium. The print transfer member then transfers the next image or returns to the rest position. The ribbon 624 is then directed, via guide roller 628 to a takeup reel (not shown).

Figure 11C:
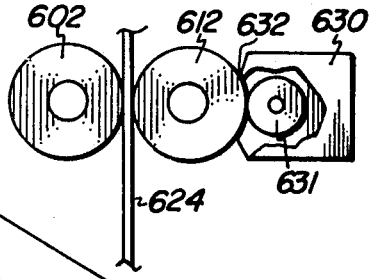
FIG. 11C is a partial view of an alternative development apparatus for FIGS. 11A and 11B.
Figure 11B:
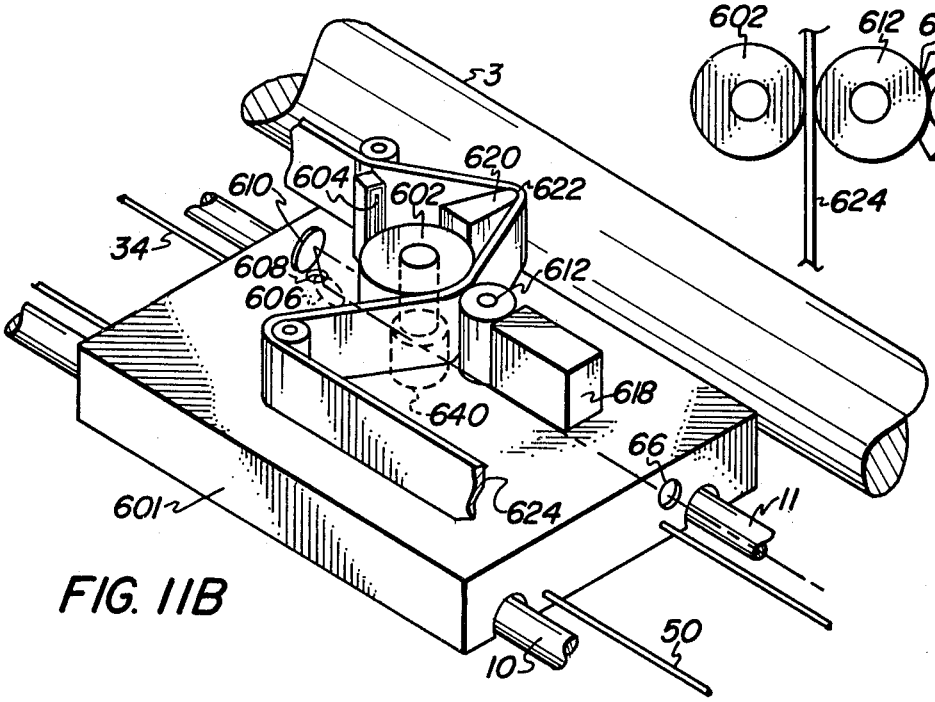

An alternative development apparatus is shown in FIG. 11C. Gravure roller 612 is supplied with a liquid developer from reservoir 630 as by applicator roll 631 and wiped clean by doctor edge 632 before passing onto the development zone.

Xerographic Print Heads (conventional)

In the process of electrophotographic printing, as disclosed in U.S. Pat. No. 2,297,691 issued to Carlson in 1942, an image bearing member having a photoconductive insulating layer is charged to a substantially uniform potential in order to sensitize its surface. This charged photoconductive surface is exposed to a light image of an original. The charge is selectively dissipated in the irradiated areas in accordance with the light intensity projected onto the photoconductive surface. Development of the electrostatic latent image recorded on the photoconductive surface is attained by bringing a developer mix of carrier granules and toner particles into contact therewith. Typically, the toner particles are heat setable, dyed or colored thermoplastic powders, and the carrier granules are frequently ferro-magnetic granules. The developer mix is generally selected such that the toner particles acquire the appropriate charge relative to the electrostatic latent image recorded on the photoconductive surface, the greater attractive force in the electrostatic latent image causes the toner particles to be transferred from the carrier granules and adhere thereto. Therefore, the toner powder image, developed on the photoconductive surface, is transferred to a sheet of support material. Subsequently, the toner powder image transferred to the sheet of support material may be permanently affixed thereto by suitable means.

Many improvements and discoveries have been made in recent years which make the above-described process suitable for a wide range of imaging functions. For instance, as shown also by the previous embodiment, by interposing a thin insulating sheet in front of the electrical latent image it has been found that the image may be developed on the side of the sheet opposite to the photoconductor. As will be seen further below, this is a definite advantage in some instances.

Figure 12A:
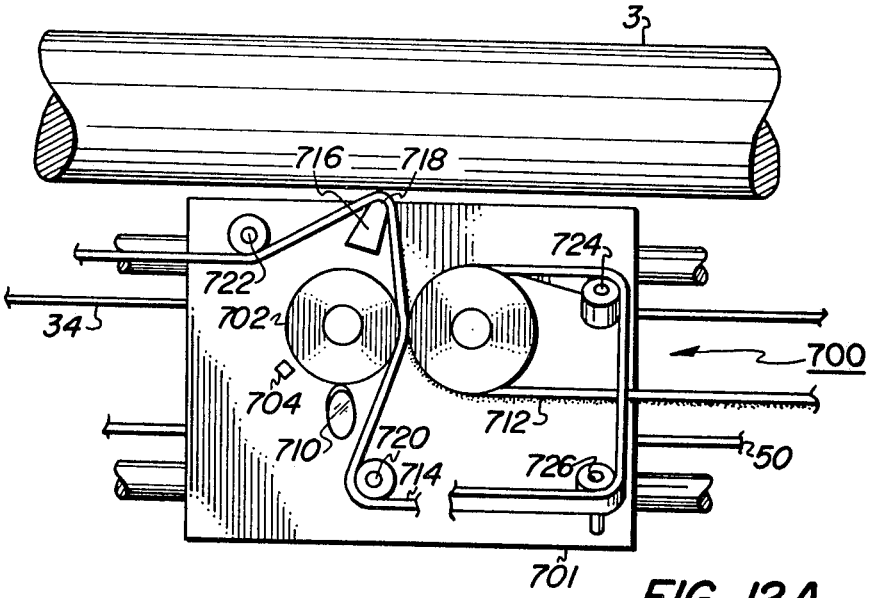
FIGS. 12A, B, D and E are top plane and perspective views, respectively, of an embodiment of a print head which employes xerographic touchdown development techniques.
Figure 12B:
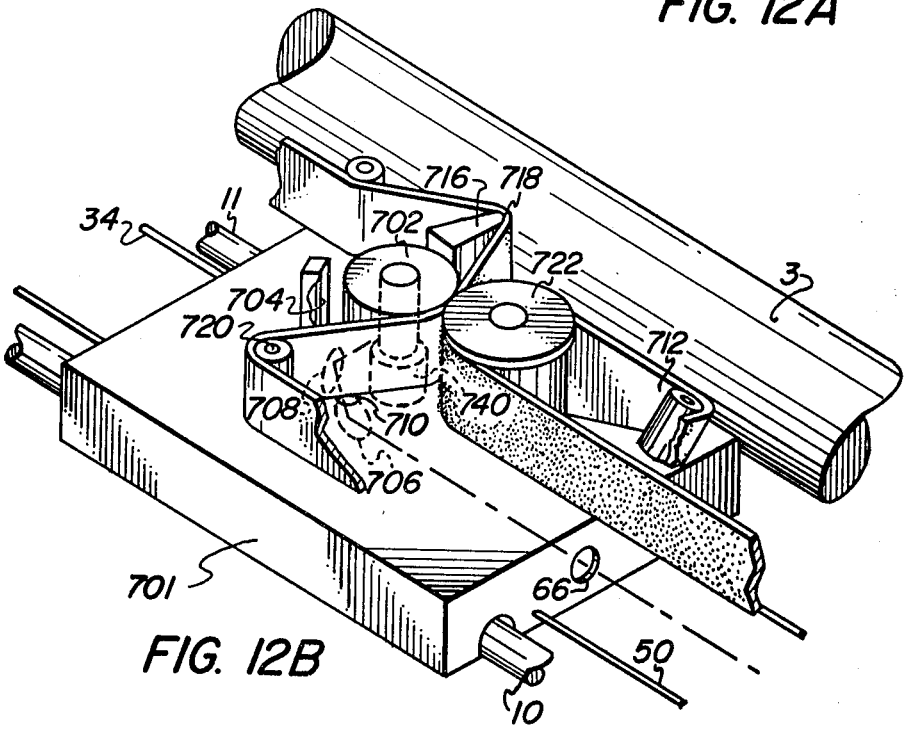
FIG. 12C is a partial view of a modification of the touchdown development apparatus of FIGS. 12A and B.

FIGS. 12A and 12B are directed to an embodiment of a printing head which employs the xerographic process described above. The print head 700 is comprised of a base member 701 which supports the necessary exposure, development and transfer mechanisms. The base member may take any suitable configuration, such as, for example, the rectangular plate shown, and may be constructed of any suitable material, preferably low in mass.

The heart of this xerographic print head is the photoreceptor 702 which comprises a photosensitive material in either layer or binder form. Any of the photoreceptors well-known in the art will be suitable.

The photoreceptor is in the shape of a drum and is rotatably mounted upon the drive shaft of step motor 740 (FIG. 12B) whereby, upon rotation, the imaging steps may be sequentially performed upon the surface thereof. The drum is at least one character in height and preferably of such a diameter that several characters may be carried on the periphery at one time. Charging station 704 is located ahead of the exposure station and is an element well-known in the art for depositing a uniform charge on a surface, e.g., see U.S. Pat. No. 2,836,725. The charged photoreceptor is exposed to the desired alpha-numeric character through an illumination system comprised of lens 66, reflection mirror 706, opening 708 and reflection mirror 710.

The electrical latent image is developed through the insulating ribbon 714 by bringing donor belt 712 into close proximity to, or slight contact with the image whereby the toner particles are selectively transferred.

Print transfer member 716, which optionally may be heated, is slidingly attached to base member 701 whereby the pressure point thereof, 718, may move the ribbon into and out of contact with the receiving medium on platen 3. The movement of member 716 is controlled via cable 34 as shown in FIG. 2B.

In operation, the print head 700 is moved along the two shafts 10 and 11 by command through control cable 50. The base member is coated away from platen 3 to permit the receiving medium, for instance a sheet of paper, to be fixed to the platen and moved relative thereto without interference from the print head. The ribbon 714 is a thin insulator, for example Tedlar, and is directed from a supply reel (not shown) around guide roller 120 and into intimate contact with photoreceptor 702. Donor belt 712 may take many forms known in the art, but for purposes of description may be assured to consist of a conductive base, a thin insulating layer and a conductive screen with a toner layer thereon. The donor belt presents toner to the electrostatic latent image on the ribbon 714 as it passes in close proximity thereto. Relatively large guide roller 722 has at least one flange thereon which maintains a separation between the top of the toner on the donor belt and the ribbon 714. This separation minimizes background.

As the ribbon moves across print transfer member 716 and the print head 700 moves along the platen, print transfer member 716 begins its movement toward the platen. This movement is controlled by structure as shown in FIG. 2B. As the toned image reaches pressure point 718, it has reached its furthest extension and is pressing the marking material against the receiving medium on platen 3. The motion of the print head causes a pressured wiping action which deposits the toner on the receiving medium. The print transfer member then transfers the next imagewise shaped toner image or returns to the rest position. The insulating ribbon 714 is directed, via guide roller 722, to a takeup reel (not shown) as is used donor ribbon via rollers 724 and 726. The takeup reels may be one in the same, but each ribbon would have its own supply (not shown).

Figure 12D:
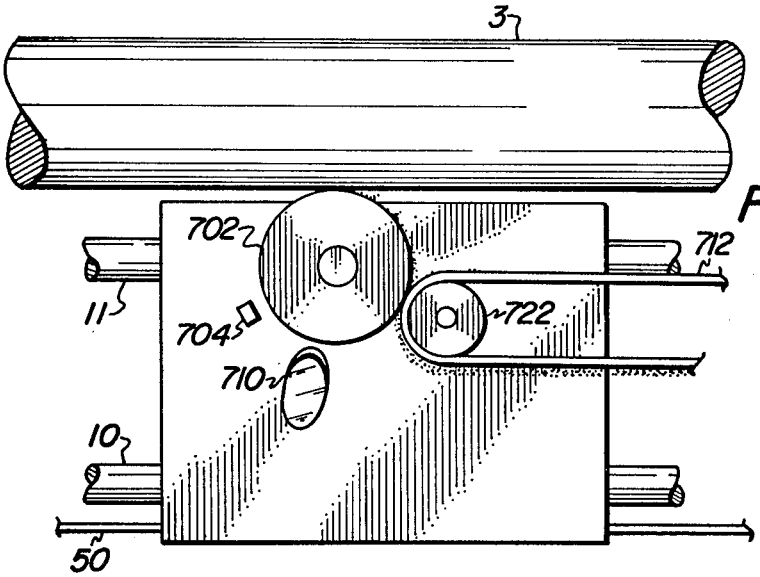
Figure 12C:
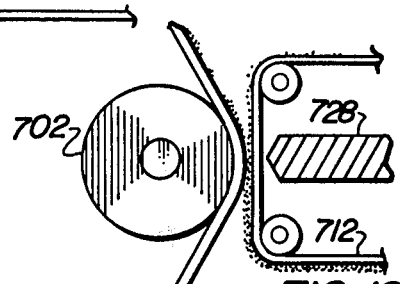

In the alternative development embodiment shown in FIG. 12C, toner transfer is assisted by a charged knife blade 728. The charged blade concentrates the imagewise field and assists the toner particles in jumping the gap in an imagewise fashion.

Figure 12E:
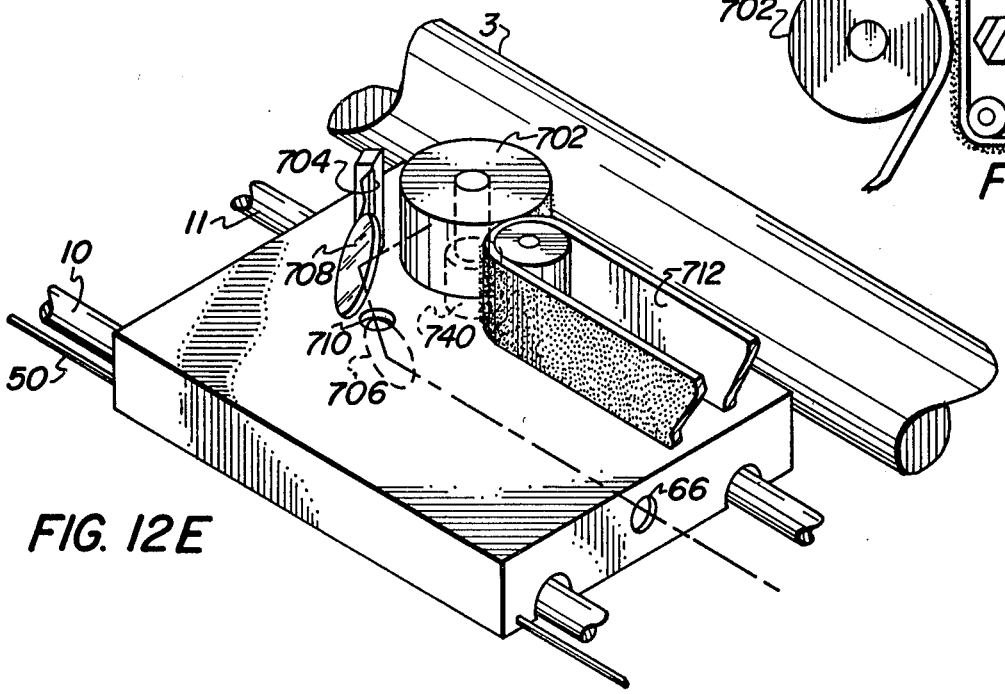

FIGS. 12D and 12E depict an additional xerographic embodiment which is substantially the same as that shown in FIGS. 12A and B. The primary difference is that the photoreceptor drum 702 is not stationary, but rather moves under command into and out of contact with the receiving medium on platen 3.

In operation, a latent image is created on the drum and developed by donor 712. As the drum rotates under control of motor 740, it moves into contact with the receiving medium and transfers the developed image thereto. The movement of the drum is controlled as member 30 in FIG. 2B. The drum then returns to its initial position and receives the next image. It is possible to place several developed images on the drum before transfer, thereby reducing the required drum movement.

While other structures are possible, it is convenient to visualize the motor 740 as being rigidly associated with the drum and moving with it toward the receiver.

This particular embodiment may optionally include a cleaning station near the drum prior to the charging station 704. Such cleaning apparatus is known in the art, and its employment presents no unusual problems.

Xerographic Embodiment with Transparent Photoreceptor

The structure shown in FIGS. 13A-D also relates to an impactless printing apparatus based upon the well-known imaging technology of xerography. The keyboard, logic and synchronous head drive are the same as described in previous embodiments and will therefore not be set forth in detail.

The platen 3 rotates about its horizontal axis under command signals from the logic circuitry and operates to move a receiving medium, usually paper, for receipt of the printed information. The printing cycle is concerned mainly with the performance of the various process steps upon an electrically photosensitive member which is in the form of a flexible ribbon contained by a supply reel and a driven takeup reel. Photosensitive member 750 is sufficiently transparent to allow a radiation image to pass therethrough and may take any of the forms well known in the art, as for example, a Mylar base (about 1 mil), a conductive layer (about 50A) and a Photoconductive layer (about 1 mil or less), usually organic. As will be appreciated after later discussion, the photosensitive member preferably exhibits a low surface energy to promote ease of release. This is easily accomplished by coating the surface with a releasing agent such as Teflon. Furthermore, the member 750 is generally considered to be a disposable component, but may be of such character as to be reusable two or more times. The ribbon is situated such that the Photoconductive surface thereof faces the platen 3. The ribbon itself is sequentially transported through the process stations which are: charging 751, exposure and development 752 and transfer 753 (FIG. 13B).

Upon striking a character key the ribbon 750 is moved downward, past corona charging means 754 which may take any of the forms well known in the art such as those disclosed in U.S. Pat. No. 2,836,725 to Vyverberg or U.S. Pat. No. 2,777,957 to Walkup. After a uniform charge is placed upon the photosensitive member, it is further lowered into registry which bridge member 755 as shown in detail in FIG. 13C. The bridge member serves several purposes, but primarily insures a 2–10 mil gap between the toner laden donor belt 756 and photosensitive ribbon 750.

The ribbon 750 is transported through the various stations by movable frame member 757. Frame member 757 has the supply and takeup reels 758 and 759, respectively, rotatably mounted thereon so that these elements move up and down with the frame member, thereby transporting the ribbon through the station sequence. Takeup reel 759 is driven by an electric motor 760. Nut 761 is fixed to frame member 757 and threaded onto lead screw 762. The lead screw is rotatably supported at one end by a support base and driven at the other end by step motor 763, which is also fixed to a support. When motor 763 is activated, lead screw 762 rotates, causing the frame member 757 to move. Guide rods 764 insure that the frame member moves in substantially the desired path without undesirable motion.

The exposure and development station 752 structurally provides for flash exposure of the photosensitive member and touchdown development of the electrostatic latent image formed thereon. For convenience, it will be assumed that the front of the photosensitive element is that surface which is photoconductive, therefore, the instant system provides exposure through the rear and development on the front.

Exposure head 765 is slidingly mounted on shafts 10 and 11 and moves therealong under the command of control cable 50. Negative images (dark background) are projected from the illumination system through lens 66 onto reflection mirror 766, through opening 767, onto mirror 768 and thence to the photosensitive member 750. Negative images are required because they allow the superposition of successive character images onto member 750.

Toner donor belt 756 is an endless loop electrode which is kept at the same polarity or potential as photosensitive member 750. The belt is positioned on guide rollers to direct its travel onto bridge member 755 and through toner loading chamber 769. While in chamber 769, paddle wheel 770 or other suitable means, loads the toner 772 thereon. Slit exit openings 774 serve as a seal to prevent unwanted toner from escaping from the chamber and also insures that the belt 756 is not too highly loaded. The donor belt is driven by controlled friction drive roller 776, or other suitable means.

Figure 13A:
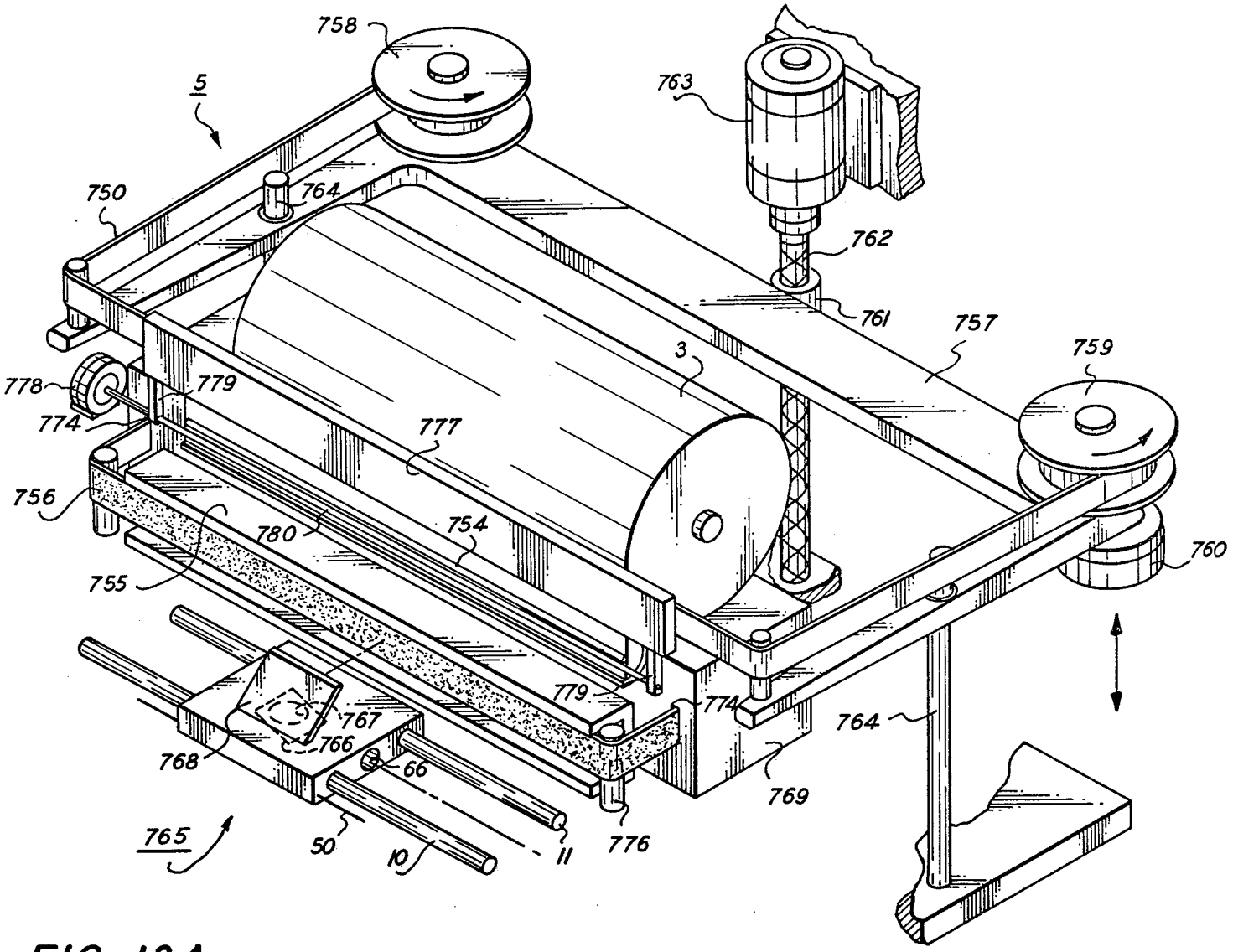
FIGS. 13A and B are partial perspective and side plane views, respectively, of another embodiment of printing apparatus which employs xerographic imaging techniques, with transparent photoreceptor.
Figure 13B:
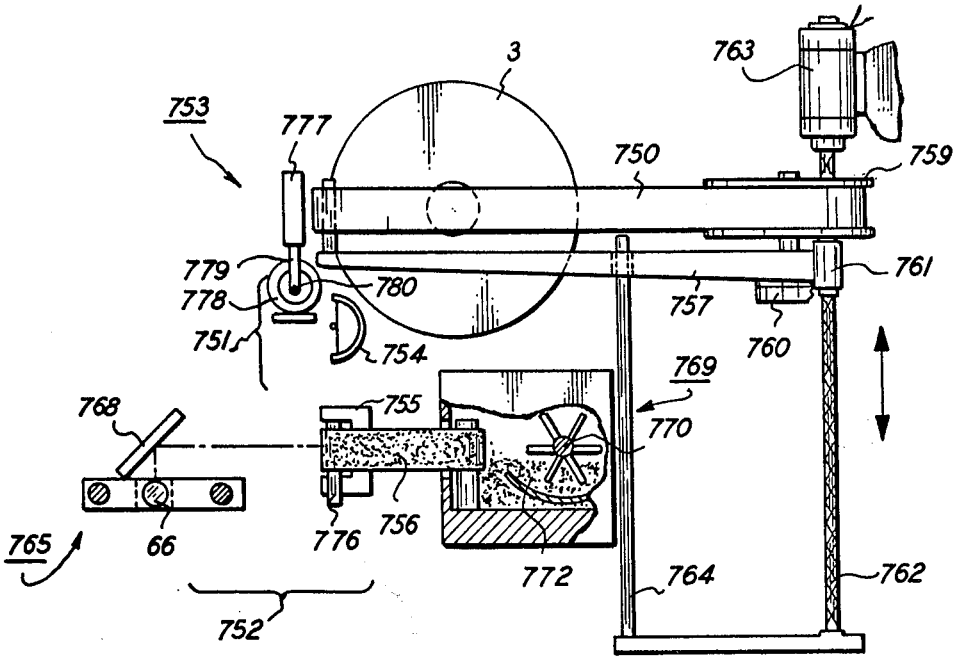
FIG. 13C is a partial side view of the development area of FIGS. 13A and B.
FIG. 13D is a partially schematic, partially cross-sectional view of the image transfer member shown in FIGS. 13A and B.
FIG. 13E is a partially schematic, cross-sectional view of a magnetic development apparatus suitable for use with the printing apparatus of FIGS. 13A and 14B.
Figure 13C:
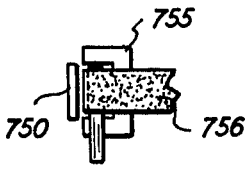
Figure 13D:
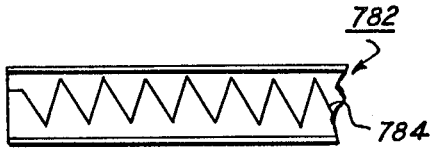

After a full line of characters has been printed, the carriage return key is punched and the image laden photosensitive element 750 is moved into the transfer position shown in FIGS. 13A and 13B. Heat transfer element 777 is then moved from its rest position, completely out of alignment with photosensitive member 750, into the transfer position shown in FIGS. 13A and 13B. Rotation solenoid 778 acts upon pivot arm 779 to rotate element 777 about rod 780 approximately 90° into and out of the transfer position. The heated transfer element, as best shown in FIG. 13D, which may be curved to fit platen 3 is of a rubbery material (e.g., silicone) with conductive wires 784 therein for heating the surface thereof (e.g., nickel). Any suitable pattern for the heating wires may be used, a zig-zag pattern being shown for illustration. In the alternative, a relatively small horizontally translated heated shoe could be used to perform the transfer step, but it would result in somewhat slower operation.

The transfer element is brought into intimate contact with the photosensitive member 750 and platen 3 to effect transfer and fusing. The rubbery characteristics and shape of element 777 are chosen to cause it and the photosensitive member to conform to the rounded contour of the platen 3.

The solid state control curcuitry is programmed such that the member 750 stays in the lower exposure and development position until either the carriage return key is struck, which causes transfer, or a specific time lapse occurs, e.g., ½ second. The time lapse relates generally to the speed of the operator and may be adjustable. By allowing the time lapse to occur, it is possible to view the imaged line before transfer, e.g., to check for errors. This is possible because the heat transfer element 777 is not in its transfer position and the photosensitive member is transparent.

Should an error be detected before transfer, the exposure head is backspaced to the last correct character before the error and an error key depressed. This automatically causes a complete new segment of photosensitive material and donor to move into position, and, from memory, the correct portion of the line to be reprinted. The remainder of the line is then correctly manually entered.

After the complete line is typed, the return key is depressed, the developed image is transferred, the platen rotates one line and the photosensitive and donor member advance one sequence. The next line is then ready for typing.

In certain circumstances the charge decay rate of the photosensitive member may affect the quality of the printed image, for example, if the typing is unusually slow. This is not usually a problem under normal conditions, however, the logic circuitry has a built in time control whereby the member 750 is recharged if transfer is not instigated within a set period.

It should also be noted that the operating speed of this embodiment may be significantly increased in an automatic printing mode by modifying the exposure system to include a second exposure head. The mounting of the two heads would also have to be modified so that they could be moved about a closed loop whereby one head would be in position on the left margin as the other moved out of position on the right.

The elements described go together to form an apparatus which forms alpha-numeric characters upon a sheet of paper. Therefore, it is obvious that the size of the elements generally permit the receipt of standard sized sheets—usually 11–16 inches in width.

Additionally, it should be apparent that the photosensitive member, while not in the viewing position, has to be protected from room light by shielding the lower region.

Figure 13E:
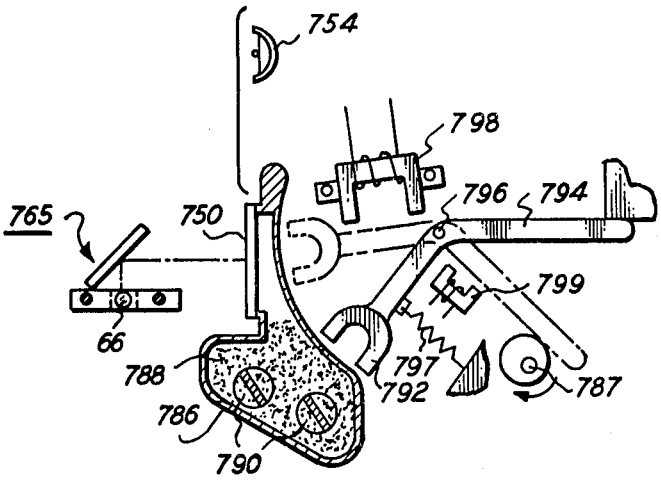

FIG. 13E shows an exceptionally effective alternative development station suitable for use in the xerographic embodiments. This embodiment would, for example, be substituted for the touchdown development station of FIGS. 13A and B.

Photosensitive ribbon member 750 is uniformly charged as it moves downward past corona charging means 754 to the position shown in FIG. 13E adjacent an opening in developer chamber 786. Developer chamber 786 is of any suitable size, but generally should be at least as long as the print path, or platen 3. The chamber has a reservoir in the lower portion thereof containing the magnetic development medium 788. An auger(s) 790 may be placed in the reservoir to insure even distribution and prevent caking of the material.

After the creation of an electrostatic latent image on photosensitive member 750, sufficient amount of magnetic developer material 788 is picked up by magnet 792 and transported to the latent image to effect development. The magnet may be either permanent or electrically activated, depending upon design considerations. Also, it should be noted that chamber 786 should be narrow enough to allow the transported material to sweep by the latent image and develop same with a suitable volume of developer.

The magnet 792 can be caused to fluctuate between the pickup and development positions by innumerable structures; however, the arrangement shown is quite simple and reliable. The magnet 792 is fixed to support arm 794 which pivots about point 796 in response to electromagnet 799. Spring 797 aids the return motion of the magnet 792 from the development and pickup positions. When magnet 792 is in the development position, arm 794 rests upon cam 787 which causes the magnet to "jiggle" the developer material adjacent the latent image.

Many variations in the above-described structure are possible, but certain advantages accrue to a system which employs a characterized magnet as 792 for each printing position. Each magnet would have its own control electro-magnet 799, the activation of which would be tied to the position of the exposure head 765. Such an arrangement is an obvious advantage which results in superior characters. In certain instances, it may be desirable, e.g. in the automatic modes, to develop the characters a line at a time. This is accomplished by activating electro-magnet 798 which extends the full length of the printing line.

In a particularly preferred embodiment, the logic system would provide an internal clock function similar to that previously described. For example, if a partial line of characters is developed on member 750 and no further entry is made for ¼ second, the ribbon will move to its transfer position as shown in FIG. 13B. When the next entry is made, the ribbon goes down to the exposure-development position of FIG. 13E and is recharged. Then, the logic circuitry and memory unit causes the head 765 to backspace one character and re-expose the previously entered character, and then expose and develop the newly entered character. This procedure prevents the character being entered from scavenging the adjacent character.

Xerographic Embodiment with Interposition

The embodiment to be described immediately below, like the preceding embodiment, is based upon xerographic technology. Also, the keyboard logic control circuitry and synchronous head drive mechansims described in relation to other embodiments can be used herein.

Referring now to FIGS. 14 A–C, the platen 3 rotates about its horizontal axis under command signals from the logic circuitry and operates to move a receiving medium, usually paper, for receipt of the printed information. The printing cycle is concerned primarily with the performance of the various process steps which result in a developed image upon interposition member 800 which may be transferred to the receiving medium. Member 800 is a thin transparent insulating ribbon or web (e.g. 1 mil of Tedlar) which is confined to a supply reel and a driven take-up reel except in the working areas. Member 800 may comprise any suitable insulating material which will permit the means to develop the image, e.g. paper may be sufficiently insulating at low humidity to work. The term "transparent" includes partial transparency, so long as a developed image may be viewed therethrough. As will be appreciated later, the member 800 preferably exhibits a low surface energy to promote ease of release. This is easily accomplished by providing a low surface energy coating such as Teflon.

Upon striking a character key the photosensitive element 801 is lowered past corona charging means 802 which may take any of the forms well known in the art, such as, for example, those disclosed in U.S. Pat. Nos. 2,836,725 and 2,777,957. This lowering motion includes a return to the exposure and development position of FIGS. 14A and 14B. Simultaneously with the movement of the photosensitive element 801, the interposition member 800 drops from its rest position, FIGS. 14A and 14B to that of FIG. 14C, i.e., sandwiched between element 801 and bridge member 804. Photosensitive element 801 may be raised and lowered by any of a number of well known mechanical, fluidic or electrical apparatus, but is shown to be fixed to rack 803 on one end and slide 805 on the other. Step motor 823 is geared, through gear 825, to the rack 803 and as the motor shaft rotates, the rack moves up and down. Photosensitive element 801 is well known in the art of electrophotography and may be organic or inorganic. Bridge member 804 serves several useful purposes, but primarily insures a 2-10 mil gap between the toner laden donor belt 806 and member 800.

The ribbon 800 is transported through the various stations by movable frame member 807. Frame member 807 has the supply and takeup reels 808 and 809, respectively, rotatably mounted thereon so that these elements move up and down with the frame member, thereby transporting the ribbon through the station sequence. Takeup reel 809 is driven by an electric motor 810. Nut 811 is fixed to frame member 807 and threaded onto lead screw 812. The lead screw is rotatably supported at one end by a support base and driven at the other end by step motor 813, which is also fixed to a support. When motor 813 is activated, lead screw 812 rotates, causing the frame member 807 to move. Guide rods 814 insure that the frame member moves in substantially the desired path without undesirable motion.

Exposure head 815 is slidingly mounted on shafts 10 and 11 and moves therealong under the command of control cable 50. Negative images (black background) are projected through lens 66 onto reflection mirror 816, through opening 817 onto mirror 818 and thence to the photosensitive member 801. Negative images are required because it allows superposition of character images onto member 801.

Toner donor belt 806 is an endless loop electrode which is kept at the same potential or polarity as photosensitive member 801. The belt is positioned on guide rollers to direct its travel onto bridge 804 and through toner loading chamber 819. While in chamber 819, paddle wheel 820, or other suitable means, loads the toner 821 thereon. Slit exit openings 822 serve as a seal to prevent unwanted toner from escaping from the chamber and also insures that the belt 806 is not too highly loaded. The donor belt is driven by controlled friction drive roller 824, or other suitable means.

Positioned below photosensitive member 801, is an A.C. corotron 826. This member is activated after photosensitive member 801 and interposition member 800 are separated from the toner donor belt 806 and before the photosensitive member 801 and the image laden interposition member 800 are separated. Corotron 826 is transferred to the activation position by solenoid 827. Without this corotron, upon separation of members 800 and 801 there would be a mutual repulsion force among the toner particles making up the image that tends to result in a final image with reduced image edge sharpness. Corotron 826 could, alternatively, be a D.C. corotron, placing a neutralizing charge on the toner image.

Figure 14A:
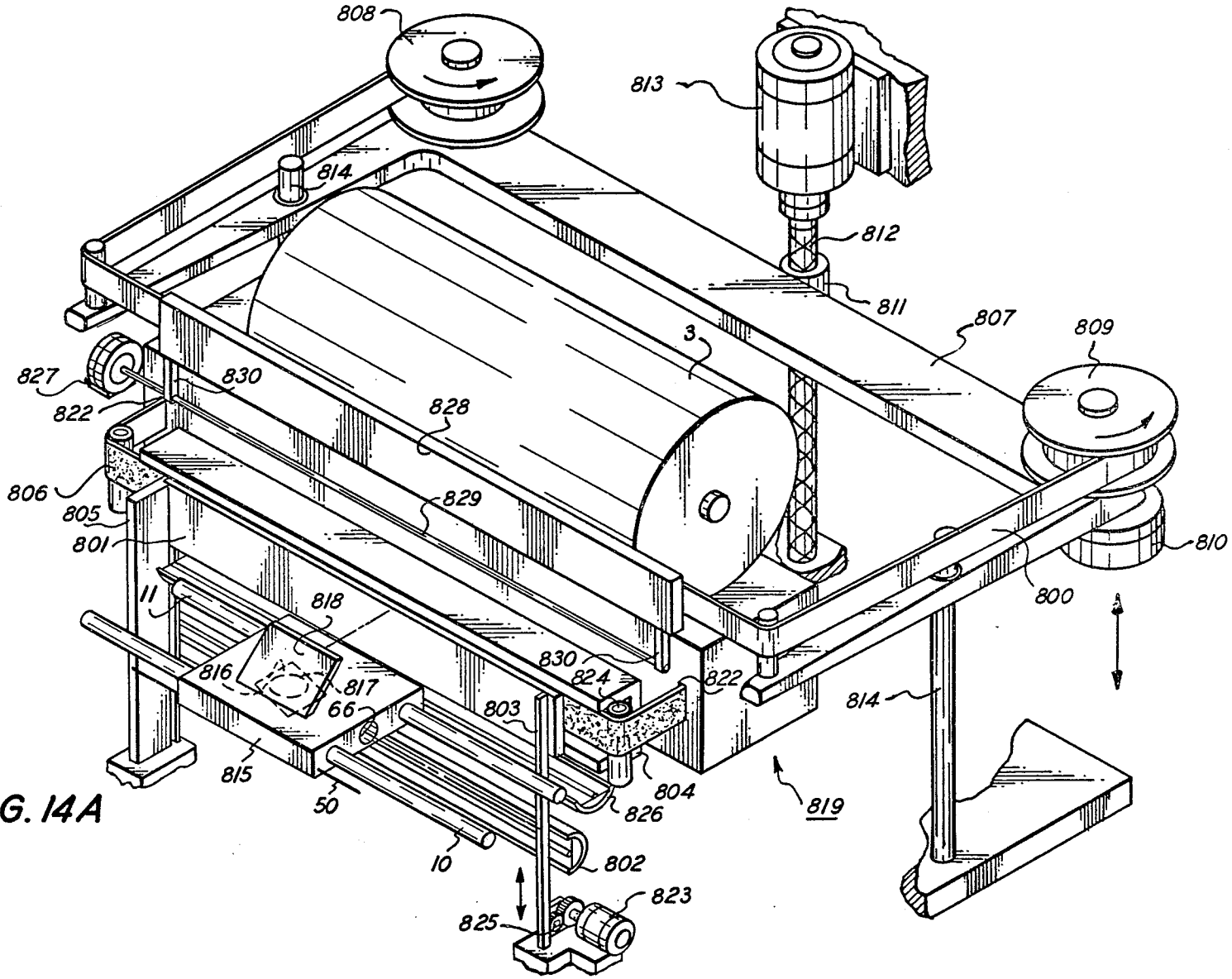
FIGS. 14A and B are partial perspective and side plane views, respectively, of yet another embodiment of printing apparatus which employs xerographic imaging techniques with an interposition member.
Figure 14B:
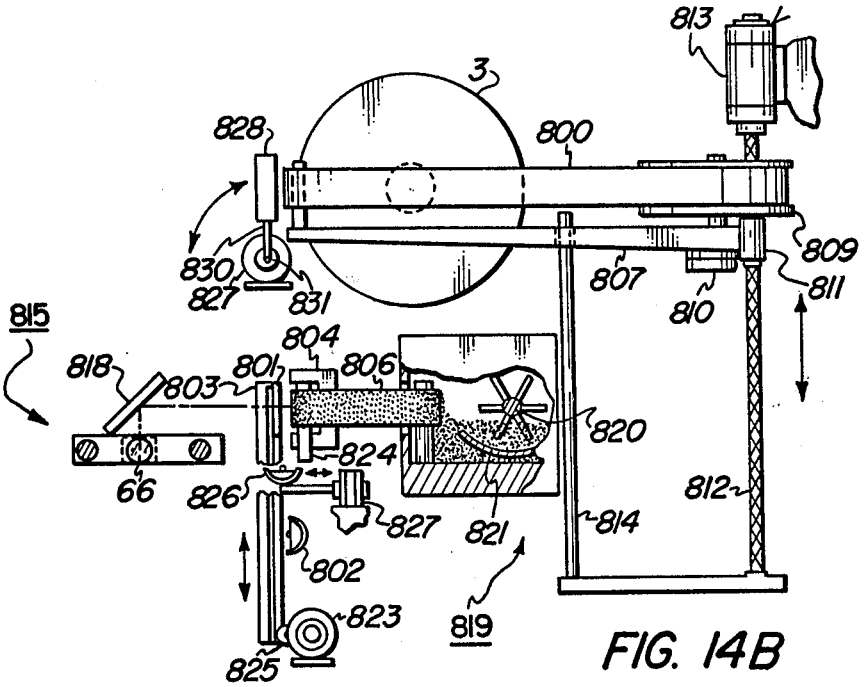
FIG. 14C is a partial side view of the development area of FIGS. 14A and B.

After a full line of characters is printed, the carriage return key is depressed and the following sequence occurs: photosensitive member 801, interposition member 800 and bridge member 804 separate and corotron 826 is activated; the interposition member 800 moves up to the transfer position shown in FIGS. 14A and 14B, and the heated transfer member 828 swings into the position shown in the same figures (this member is the same as member 777 described in the previous embodiment) under the control of rotation solenoid 827 which is attached to member 828 by rod 829 and arms 830; heated transfer member 828 presses the interposition member 800 into intimate contact with the receiving medium on platen 3 thereby transferring and fusing the image thereto; the print head 815 moves to the far left; the donor belt 806 and interposition member 800 advance one complete sequence; and the platen rotates one line. Heated transfer member 828 is moved approximately 90° into and out of the transfer position through the action of solenoid 827 upon pivoted lever arm 830.

Figure 14C:
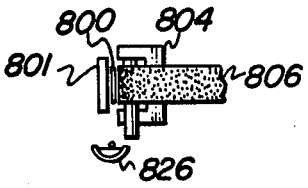

The solid state control circuitry is programmed such that the member 800 stays in the lower position of FIG. 14C until either the carriage return key is struck, which causes transfer, or a specific time lapse occurs, e.g. ½ second. The time lapse relates generally to the speed of the operator and may be adjustable. By allowing the time lapse to occur, it is possible to view the imaged line before transfer, e.g. to check for errors. This is possible because the heat transfer element 828 is not in its transfer position and the interposition member 800 is transparent.

Should an error be detected before transfer, the exposure head 808 is backspaced to the last correct character before the error and an error key depressed. This automatically causes a completely new segment of interposition material and donor to be moved into position and, from memory, the correct portion of the line to be reprinted. The remainder of the line is then correctly manually entered.

In certain circumstances, the charge decay rate of the photosensitive member may affect the quality of the printed image, for example if the typing is unusually slow. This is not usually a problem under normal conditions; however, the logic circuitry has a built in time control whereby the member 801 is recharged if transfer is not instigated within a set period.

It should also be noted that the operating speed of this embodiment may be significantly increased by modifying the exposure system to include a second exposure head. The mounting of the two heads would also have to be modified so that they could be moved about a closed loop whereby one head would be in position on the left margin as the other moved out of position on the right.

The elements described go together to form an apparatus which forms alpha-numeric characters upon a sheet of paper. Therefore, it is obvious that the size of the elements generally permit the receipt of standard sized sheets—usually 11–16 inches in width.

Additionally, it should be apparent that the photosensitive member would have to be shielded from room light. Furthermore, it should be understood that the magnetic development apparatus shown in FIG. 13E may easily be substituted for the development system shown in FIGS. 14A and 14B.

Toner Belt System

The two immediately preceding xerographic embodiments of an impactless printing apparatus rely upon touchdown development to create a viewable image on either a photosensitive member or an interposition member. The toner donor belt runs through a channel within a bridge member in order to accurately position the toner relative to an electrostatic latent image. The system to be described below is an alternative to the cascade loading system within the toner loading chamber.

Figure 15B:
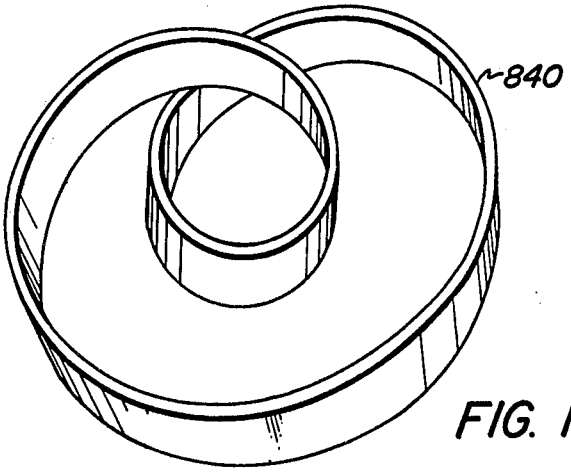
FIG. 15B is a perspective view of the donor belt of FIG. 15A.
Figure 15A:
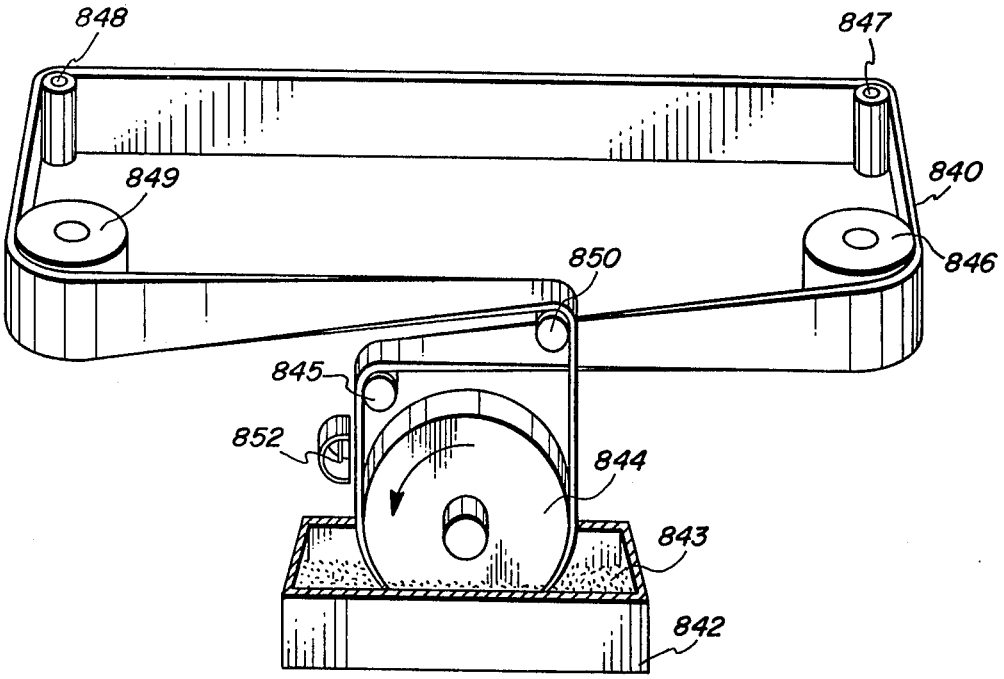
FIG. 15A is a partial schematic of an alternative development scheme for the FIGS. 13 and 14 printing apparatus.

Referring now to FIG. 15A, a conductive toner donor belt 840 is formed in a closed loop, as will be further explained, and situated on various rollers to provide a surface which never contacts any of the rollers. This contact-free surface is highly efficient and well suited as a donor surface.

The belt 840 itself may be made of any of a number of materials, either conductive or insulative as taught in U.S. Pat. No. 3,487,775.

It has been found that most methods of applying marking material to a donor impart sufficient triboelectrically generated electrostatic charges to the marking material to cause the material to releasibly adhere to the donor. However, to impart additional charge to the marking material on a loaded donor or to refresh a loaded donor, independent means are known in the art to impart additional electrostatic charges to the marking material. These same means may be used to precharge an electrically insulating donor to increase its capacity to accept and releasably retain marking material. These means include corona charging an insulating layer and placing a bias on a conductive layer.

For convenience of illustration, belt 840 will be assumed to be a thin insulating layer such as Tedlar.

Suspended within toner containing tray 842 is biased drum 844 which forms an electrostatic development field which attracts toner 843 from the tray 842. The belt is situated on guide rollers 845–850 in such a manner that the tone laden surface thereof never touches a roller. Corotron 852 charges the toner layer which is then transported to the position between rollers 847 and 848. It is at this location that the belt rests upon the bridge member mentioned above. The drum 844 is driven under command of the logic circuitry and rotates to frictionally advance the donor as required.

It should be noted from FIGS. 15A and B that the belt 840 is made from a moebius strip. In other words, the belt is formed with a 360° axial twist, as shown in FIG. 15B.

Furthermore, it should be understood that the toner tray 842 may be continuously vibrated to prevent caking and promote charging of the particles. Also, the tray and drum may be enclosed to suppress the contamination of apparatus due to cloud formation.

Alternatively, and possibly preferably, the toner tray can be replaced by a narrow width magnetic brush which deposits a toner layer on the belt by solid area developing the bias on roll 844.

Donor Belt

Figure 16A:
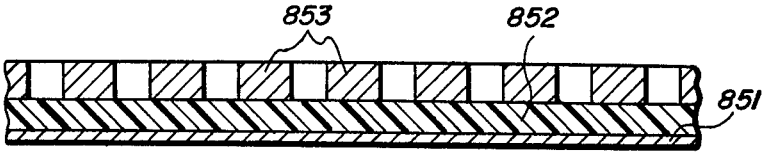
FIGS. 16A, B and C are views of an alternative embodiment of a donor belt.

An improved donor member for use in any suitable development environment, especially the one set forth immediately above, is shown in FIGS. 16A, B and C.

A thin conductive base layer 851 with a thickness of from about 25 to about 125 microns aids in the creation and maintenance of an electrical field, and also serves as a support for the member. Any suitable conductive material may be used, including nickel, copper and aluminum.

A thin insulating layer 852 is positioned upon conductive layer 851 in contact therewith. Layer 852 has a thickness from about 25 to about 50 microns and may comprise any suitable insulating material such as Tedlar, Mylar or polysulphone.

A screened conductive pattern 853 is then placed upon the free surface of insulating layer 852. The screen comprises a conductive material layer, such as described above, containing a pattern of substantially square openings ranging from about 250 to about 350 microns on a side. The screen is preferably from about 7 to about 20 microns thick.

Figure 16B:
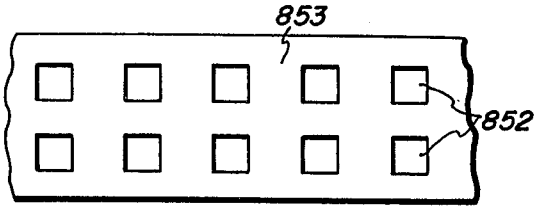
Figure 16C:
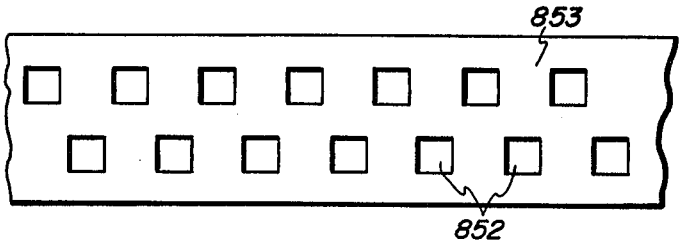

The pattern itself may be regular or irregular in nature but preferably takes one of the forms shown in FIGS. 16B and C, with approximately 50 percent open area. This open area is provided by lands of from about 50 to about 75 microns.

The donor member described, when properly charged or biased, produces a maximum amount of toner in a minimum amount of space and results in a superior touchdown development system.

It will be understood that various other changes of the details, materials, steps, arrangements of parts and uses which have been herein described and illustrated in order to explain the nature of the invention will occur to and may be made by those skilled in the art, upon a reading of this disclosure, and such changes are intended to be included within the principles and scope of this invention.

Although specific components and process steps have been stated in the above description of preferred embodiments of the invention, other suitable materials, proportions, elements and process steps, as listed herein, may be used with satisfactory results and varying degrees of quality. In addition other materials which exist presently or may be discovered may be added to materials used herein to synergize, enhance or otherwise modify their properties.

What is claimed is:

1. Apparatus for transporting particulate development material from a container to a remote location comprising:

a. a rotatable electrically grounded drum member adapted to be at least partially submerged in the particulate material in the container;

b. means to rotate said drum member;

c. an electrically insulating belt member in the form of a moebius strip wrapped partially around said drum member, said belt member comprising:

a layer of electrically conductive material on the drum member contacting side of said belt member;

a layer of electrically insulating material contacting one surface of the layer of electrically conductive material;

an electrically continuous screen pattern of electrically conductive material contacting the free surface of said layer of electrically insulating material;

d. rotatable guide means supporting the remainder of said belt member in a plane substantially parallel to the axis of said drum member, whereby one surface of said belt member never contacts said drum member or said guide means; and e. charging means adjacent said drum member for placing a substantially uniform electrostatic charge upon said belt member.

* * * * *